US009555998B2

(12) United States Patent
Watanabe et al.

(10) Patent No.: US 9,555,998 B2
(45) Date of Patent: Jan. 31, 2017

(54) SHEET PROCESSING DEVICE, IMAGE FORMING SYSTEM, AND SHEET PROCESSING METHOD

(71) Applicants: Takahiro Watanabe, Kanagawa (JP); Tomohiro Furuhashi, Kanagawa (JP); Michitaka Suzuki, Kanagawa (JP); Tomomichi Hoshino, Kanagawa (JP); Akira Kunieda, Tokyo (JP); Yuji Suzuki, Kanagawa (JP); Satoshi Saito, Kanagawa (JP); Koki Sakano, Kanagawa (JP)

(72) Inventors: Takahiro Watanabe, Kanagawa (JP); Tomohiro Furuhashi, Kanagawa (JP); Michitaka Suzuki, Kanagawa (JP); Tomomichi Hoshino, Kanagawa (JP); Akira Kunieda, Tokyo (JP); Yuji Suzuki, Kanagawa (JP); Satoshi Saito, Kanagawa (JP); Koki Sakano, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 93 days.

(21) Appl. No.: 14/609,900

(22) Filed: Jan. 30, 2015

(65) Prior Publication Data

US 2015/0225201 A1 Aug. 13, 2015

(30) Foreign Application Priority Data

Feb. 7, 2014 (JP) ..... 2014-022655

(51) Int. Cl.
*B65H 45/20* (2006.01)
*B65H 45/16* (2006.01)
(Continued)

(52) U.S. Cl.
CPC ..... *B65H 45/20* (2013.01); *B65H 9/006* (2013.01); *B65H 29/60* (2013.01); *B65H 45/14* (2013.01);
(Continued)

(58) Field of Classification Search
CPC ..... B65H 45/16; B65H 45/20; B65H 45/30; B65H 2801/27
(Continued)

(56) References Cited

U.S. PATENT DOCUMENTS 5,350,169 A * 9/1994 Hiroi et al. ..... 271/213
6,889,971 B2 * 5/2005 Tamura et al. ..... 270/58.11
(Continued)

FOREIGN PATENT DOCUMENTS

JP 2013-060246 4/2013

OTHER PUBLICATIONS

U.S. Appl. No. 14/274,493, filed May 9, 2014.

*Primary Examiner* — Leslie A Nicholson, III
(74) *Attorney, Agent, or Firm* — Harness, Dickey & Pierce, P.L.C.

(57) ABSTRACT

A sheet processing device includes: a folder that forms a plurality of folds on a sheet such that a fold part and a part with no fold of the sheet overlap with each other; a conveyance unit that conveys the sheen on which the folds are formed by the folder; and a pressing part that presses the fold part of the conveyed sheet in which the fold part and the part with no fold overlap with each other, from a side on which the fold part is located.

18 Claims, 33 Drawing Sheets

(51) Int. Cl.

| | |
|---|---|
| ***B65H 29/60*** | (2006.01) |
| ***B65H 45/14*** | (2006.01) |
| ***B65H 9/00*** | (2006.01) |
| ***B65H 45/30*** | (2006.01) |

(52) U.S. Cl.
CPC ..... *B65H 45/16* (2013.01); *B65H 45/30* (2013.01); *B65H 2301/4493* (2013.01); *B65H 2403/72* (2013.01); *B65H 2403/92* (2013.01); *B65H 2404/10* (2013.01); *B65H 2404/153* (2013.01); *B65H 2404/1521* (2013.01); *B65H 2404/563* (2013.01); *B65H 2511/11* (2013.01); *B65H 2511/212* (2013.01); *B65H 2513/10* (2013.01); *B65H 2513/11* (2013.01); *B65H 2513/512* (2013.01); *B65H 2557/242* (2013.01); *B65H 2701/1123* (2013.01); *B65H 2701/11231* (2013.01); *B65H 2701/11232* (2013.01); *B65H 2701/11234* (2013.01); *B65H 2701/11238* (2013.01); *B65H 2701/13212* (2013.01); *B65H 2801/27* (2013.01)

(58) Field of Classification Search
USPC ..... 270/45; 493/454
See application file for complete search history.

(56) References Cited

U.S. PATENT DOCUMENTS

| | | | | |
|---|---|---|---|---|
| 7,052,005 | B2 * | 5/2006 | Yamakawa et al. | 270/37 |
| 7,850,156 | B2 * | 12/2010 | Iguchi et al. | 270/37 |
| 8,152,152 | B2 * | 4/2012 | Sakata | 270/52.18 |
| 8,177,211 | B2 * | 5/2012 | Iguchi et al. | 270/45 |
| 8,590,880 | B2 * | 11/2013 | Imazu et al. | 270/20.1 |
| 2014/0141956 | A1 | 5/2014 | Suzuki et al. | |
| 2014/0171283 | A1 | 6/2014 | Furuhashi et al. | |
| 2014/0179504 | A1 | 6/2014 | Nakada et al. | |
| 2014/0206516 | A1 * | 7/2014 | Hata et al. | 493/416 |
| 2014/0336031 | A1 | 11/2014 | Suzuki et al. | |
| 2015/0183612 | A1 * | 7/2015 | Awano | B65H 45/18 493/454 |

* cited by examiner

SHEET PROCESSING DEVICE, IMAGE FORMING SYSTEM, AND SHEET PROCESSING METHOD

CROSS-REFERENCE TO RELATED APPLICATIONS

The present application claims priority to and incorporates by reference the entire contents of Japanese Patent Application No. 2014-022655 filed in Japan on Feb. 7, 2014.

BACKGROUND OF THE INVENTION

1. Field of the Invention

The present invention relates to a sheet processing device, an image forming system, and a sheet processing method. Specifically, the present invention relates to a method for processing a sheet conveyed in a folded state.

2. Description of the Related Art

In recent years, electronification of information tends to be pushed forward, and image processing devices are absolutely necessary such as a printer or a facsimile used for outputting electronified information and a scanner used for electronifying documents. In many cases, such an image processing device may be configured as a multifunction peripheral having an image capturing function, an image forming function, a communication function, and the like to be utilized as a printer, a facsimile, a scanner, and a copying machine.

Among such multifunction peripherals, known is a multifunction peripheral on which a folding processing device is mounted, the folding processing device performing folding processing on a sheet on which an image is formed after the image is formed on the fed sheet to draw the image. When such a folding processing device performs folding processing on the sheet, a fold is weak and incomplete, causing a folding height to be high as it is. Accordingly, among such multifunction peripherals, known is a multifunction peripheral on which a fold enhancing device is mounted in addition to the folding processing device, the fold enhancing device performing fold enhancing processing for enhancing the fold by pressing the fold formed through the folding processing to enhance the fold and reduce the folding height (for example, refer to Japanese Patent Application Laid-open No. 2013-060246).

Examples of a method for performing fold enhancing processing by such a fold enhancing device include a method for pressing a fold formed on a sheet while conveying the sheet with a fold enhancing roller having a length corresponding to a sheet width that is laterally bridged in a direction (main-scanning direction) parallel to the fold formed through the folding processing. Examples of another method for performing fold enhancing processing by the above-described fold enhancing device include a method for sequentially pressing a fold formed on a sheet in a main-scanning direction by temporarily stopping conveyance of the sheet at a position where fold enhancing processing is performed, and moving the fold enhancing roller rotating around a rotation axis along a direction (sub-scanning direction) perpendicular to the fold formed through the folding processing, in the main-scanning direction on the stopped sheet.

However, in the fold enhancing processing method as described above, a folding wrinkle or a pressed mark may be formed on the sheet after fold enhancing processing. Such a problem may arise in a sheet-like object which is not limited to a sheet for forming and outputting an image.

In view of such a situation, there is a need to improve quality of a sheet after enhancing a fold thereof in a sheet processing device for enhancing the fold of the sheet conveyed in a folded state.

SUMMARY OF THE INVENTION

It is an object of the present invention to at least partially solve the problems in the conventional technology.

A sheet processing device includes: a folder that forms a plurality of folds on a sheet such that a fold part and a part with no fold of the sheet overlap with each other; a conveyance unit that conveys the sheen on which the folds are formed by the folder; and a pressing part that presses the fold part of the conveyed sheet in which the fold part and the part with no fold overlap with each other, from a side on which the fold part is located.

A sheet processing method includes: forming a plurality of folds on a sheet such that a fold part and a part with no fold of the sheet overlap with each other; conveying the sheen on which the folds are formed at the forming; and pressing the fold part of the conveyed sheet in which the fold part and the part with no fold overlap with each other, from a side on which the fold part is located.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The following describes an embodiment of the present invention in detail with reference to the drawings. In the embodiment, exemplified is an image forming apparatus that forms an image on a fed sheet, performs folding processing so as to form a fold in a direction (hereinafter, also referred to as a "main-scanning direction") perpendicular to a sheet conveying direction (hereinafter, also referred to as a "sub-scanning direction") on the sheet on which the image is formed, and performs fold enhancing processing by pressing the fold formed through the folding processing with a fold enhancing roller so as to enhance the fold formed through the folding processing and reduce a folding height.

Regarding such an image forming apparatus, one of the main points of the embodiment is to press the sheet from a surface on which the fold is formed in pressing the sheet to enhance the fold formed on the sheet. Due to such a configuration, the image forming apparatus according to the embodiment can prevent a folding wrinkle or a pressed mark from being formed on the sheet after fold enhancing processing. Accordingly, the image forming apparatus according to the embodiment can improve quality of the sheet after enhancing the fold thereof.

Figure 1:
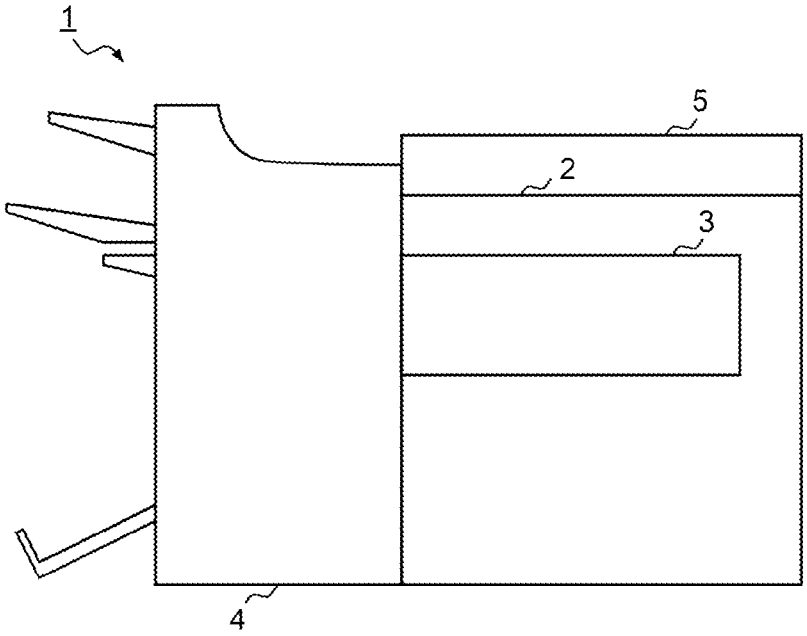
FIG. 1 is a diagram simply illustrating the entire configuration of an image forming apparatus according to an embodiment of the present invention.

First, the following describes the entire configuration of an image forming apparatus 1 according to the embodiment with reference to FIG. 1. FIG. 1 is a diagram simply illustrating the entire configuration of the image forming apparatus 1 according to the embodiment. As illustrated in FIG. 1, the image forming apparatus 1 according to the embodiment includes an image forming unit 2, a folding processing unit 3, a fold enhancing processing unit 4, and a scanner unit 5.

The image forming unit 2 generates drawing information of CMYK (Cyan Magenta Yellow Key Plate) based on input image data, and performs image formation output on a fed sheet based on the generated drawing information. The folding processing unit 3 performs folding processing on the sheet on which the image is formed and that is conveyed from the image forming unit 2. The fold enhancing processing unit 4 performs fold enhancing processing on a fold formed on the folded sheet conveyed from the folding processing unit 3. That is, in the embodiment, the fold enhancing processing unit 4, or the folding processing unit 3 and the fold enhancing processing unit 4 function as a sheet processing device.

The scanner unit 5 electronifies an original by reading the original with a linear image sensor in which a plurality of photodiodes are arranged in a line and a light receiving element such as a charge coupled device (CCD) image sensor or a complementary metal oxide semiconductor (CMOS) image sensor is arranged in parallel with the photodiodes. The image forming apparatus 1 according to the embodiment is a multifunction peripheral (MFP) having an image capturing function, an image forming function, a communication function, and the like to be utilized as a printer, a facsimile, a scanner, and a copying machine.

Figure 2:
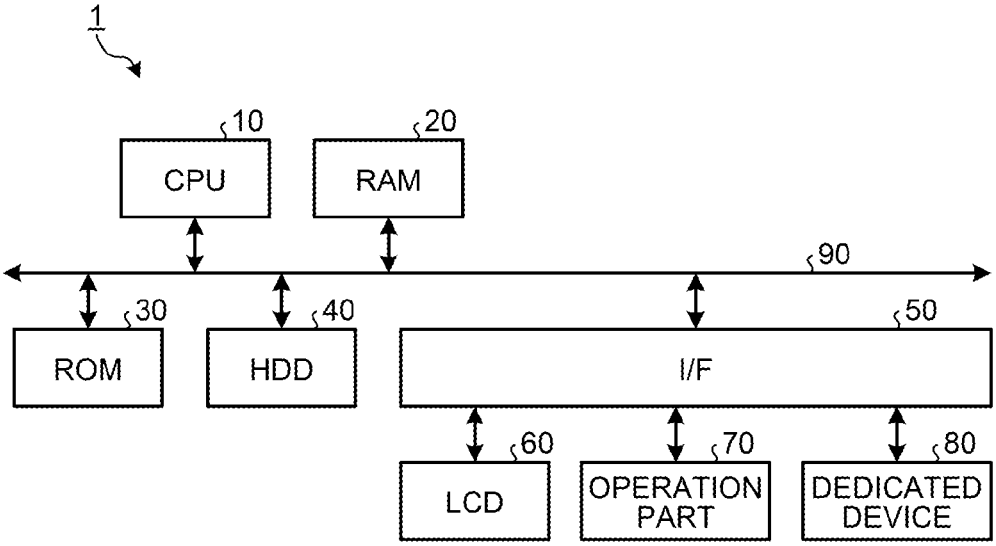
FIG. 2 is a block diagram schematically illustrating a hardware configuration of the image forming apparatus according to the embodiment of the present invention.

Next, the following describes a hardware configuration of the image forming apparatus 1 according to the embodiment with reference to FIG. 2. FIG. 2 is a block diagram schematically illustrating the hardware configuration of the image forming apparatus 1 according to the embodiment. The image forming apparatus 1 includes an engine for implementing a scanner, a printer, folding processing, fold enhancing processing, and the like in addition to the hardware configuration illustrated in FIG. 2.

As illustrated in FIG. 2, the image forming apparatus 1 according to the embodiment has a configuration similar to that of a general server, a personal computer (PC), or the like. That is, in the image forming apparatus 1 according to the embodiment, a central processing unit (CPU) 10, a random access memory (RAM) 20, a read only memory (ROM) 30, a hard disk drive (HDD) 40, and an I/F 50 are connected with each other via a bus 90. A liquid crystal display (LCD) 60, an operation part 70, and a dedicated device 80 are connected to the I/F 50.

The CPU 10 is a computing module that controls the entire operation of the image forming apparatus 1. The RAM 20 is a volatile storage medium that can read and write information at high speed, and used as a working area when the CPU 10 processes information. The ROM 30 is a read-only non-volatile storage medium in which a computer program such as firmware is stored. The HDD 40 is a non-volatile storage medium that can read and write information in which an operating system (OS), various control programs, application programs, and/or the like are stored.

The I/F 50 connects the bus 90 with various hardware or network to be controlled. The LCD 60 is a visual user interface by which a user checks a state of the image forming apparatus 1. The operation part 70 is a user interface such as a keyboard or a mouse by which the user inputs information to the image forming apparatus 1.

The dedicated device 80 is hardware for implementing dedicated functions in the image forming unit 2, the folding processing unit 3, the fold enhancing processing unit 4, and the scanner unit 5, and implements a plotter device for performing image formation output on a sheet in the image forming unit 2. In the folding processing unit 3, the dedicated device 80 implements a conveying mechanism for conveying a sheet and a folding processing mechanism for folding the conveyed sheet.

In the fold enhancing processing unit 4, the dedicated device 80 implements a fold enhancing processing mechanism for enhancing a fold of the sheet that is folded by the folding processing unit 3 and is conveyed. In the scanner unit 5, the dedicated device 80 implements a reading device for reading an image displayed on the sheet. One of the main points of the embodiment is a configuration of the fold enhancing processing mechanism included in the fold enhancing processing unit 4.

In such a hardware configuration, a computer program stored in a storage medium such as the ROM 30, the HDD 40, or an optical disc (not illustrated) is read out to the RAM 20, and the CPU 10 performs computation according to the computer program loaded on the RAM 20 to configure a software control part. A functional block that implements a function of the image forming apparatus 1 according to the embodiment is configured by combining the software control part configured as described above and hardware.

Figure 3:
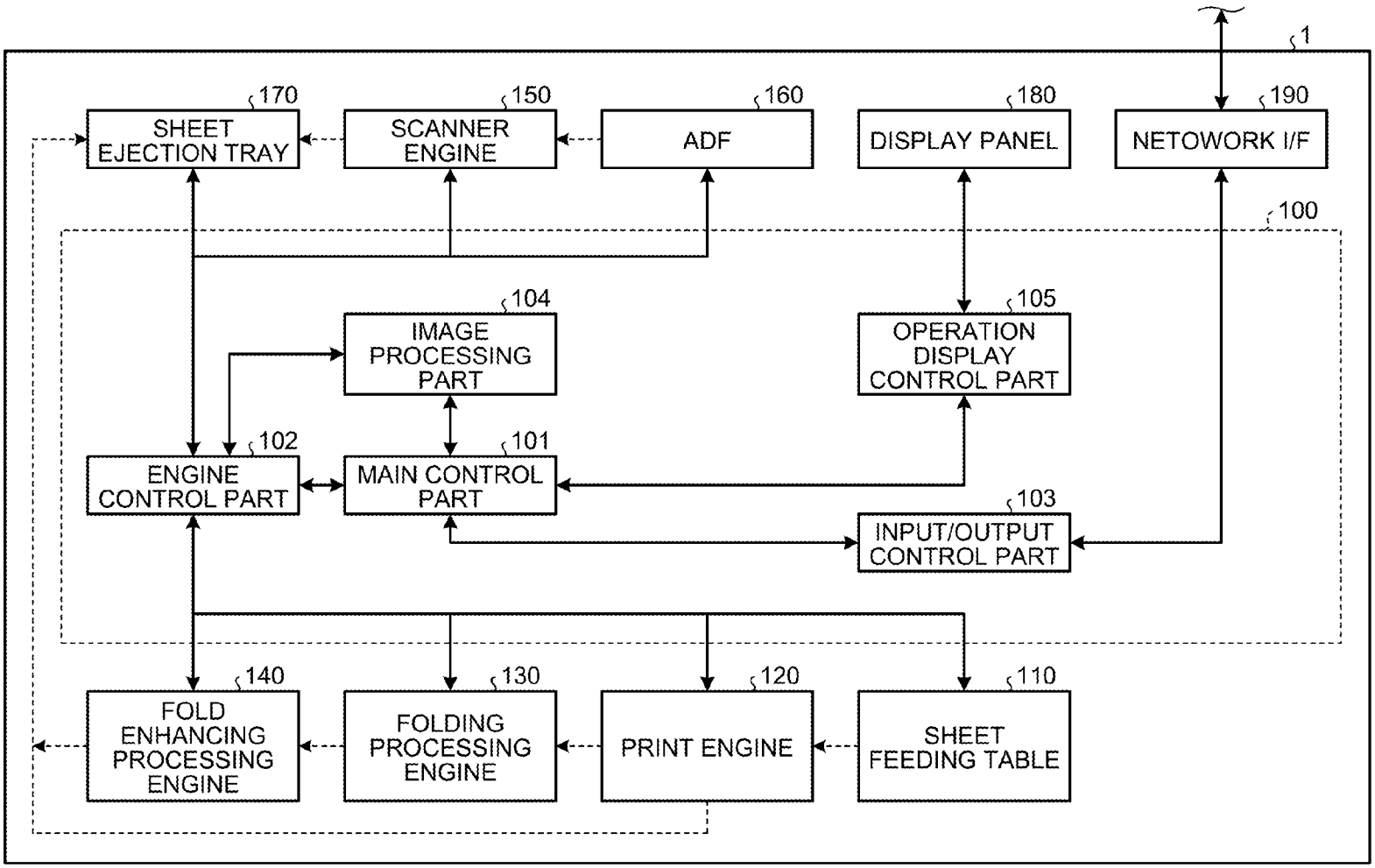
FIG. 3 is a block diagram schematically illustrating a functional configuration of the image forming apparatus according to the embodiment of the present invention.

Subsequently, the following describes a functional configuration of the image forming apparatus 1 according to the embodiment with reference to FIG. 3. FIG. 3 is a block diagram schematically illustrating the functional configuration of the image forming apparatus 1 according to the embodiment. In FIG. 3, a solid line arrow indicates electrical connection, and a dashed line arrow indicates a flow of a sheet or a document bundle.

As illustrated in FIG. 3, the image forming apparatus 1 according to the embodiment includes a controller 100, a sheet feeding table 110, a print engine 120, a folding processing engine 130, a fold enhancing processing engine 140, a scanner engine 150, an auto document feeder (ADF) 160, a sheet ejection tray 170, a display panel 180, and a network I/F 190. The controller 100 includes a main control part 101, an engine control part 102, an input/output control part 103, an image processing part 104, and an operation display control part 105.

The sheet feeding table 110 feeds the sheet to the print engine 120 serving as an image forming part. The print engine 120 is an image forming part included in the image forming unit 2, and draws an image by performing image formation output on the sheet conveyed from the sheet feeding table 110. As a specific form of the print engine 120, an ink jet image forming mechanism, an electrophotographic type image forming mechanism, and the like can be used. The sheet on which the image is drawn by the print engine 120 is conveyed to the folding processing unit 3, or ejected to the sheet ejection tray 170.

The folding processing engine 130 is included in the folding processing unit 3, and performs folding processing on the sheet on which the image is formed and that is conveyed from the image forming unit 2. The folded sheet on which folding processing is performed by the folding processing engine 130 is conveyed to the fold enhancing processing unit 4. The fold enhancing processing engine 140 is included in the fold enhancing processing unit 4, and performs fold enhancing processing on the fold formed on the folded sheet conveyed from the folding processing engine 130. The fold-enhanced sheet on which fold enhancing processing is performed by the fold enhancing processing engine 140 is ejected to the sheet ejection tray 170, or conveyed to a postprocessing unit (not illustrated) that performs postprocessing such as stapling, punching, and bookbinding processing.

The ADF 160 is included in the scanner unit 5, and automatically conveys the original to the scanner engine 150 serving as an original reading part. The scanner engine 150 is an original reading part that is included in the scanner unit 5 and includes a photoelectric conversion element for converting optical information into an electric signal, and optically scans and reads the original automatically conveyed by the ADF 160 or the original set on an original platen glass (not illustrated) to generate image information. The original that is automatically conveyed by the ADF 160 and read by the scanner engine 150 is ejected to the sheet ejection tray 170.

The display panel 180 serves as an output interface that visually displays the state of the image forming apparatus 1, and also serves as an input interface, that is, a touch panel through which the user directly operates the image forming apparatus 1 or inputs information to the image forming apparatus 1. That is, the display panel 180 has a function for displaying an image for receiving the operation by the user. The display panel 180 is implemented by the LCD 60 and the operation part 70 illustrated in FIG. 2.

The network I/F 190 is an interface through which the image forming apparatus 1 communicates with other equipment such as an administrator terminal via a network. As the network I/F 190, Ethernet (registered trademark), a universal serial bus (USB) interface, Bluetooth (registered trademark), Wireless Fidelity (Wi-Fi), FeliCa (registered trademark), or the like may be used. The network I/F 190 is implemented by the I/F 50 illustrated in FIG. 2.

The controller 100 is configured by combining software and hardware. Specifically, the controller 100 includes hardware such as an integrated circuit and a software control part configured in such a way that a control program such as firmware stored in a non-volatile storage medium such as the ROM 30 or the HDD 40 is loaded on the RAM 20 and the CPU 10 performs computation according to the control program. The controller 100 functions as a control part that controls the entire image forming apparatus 1.

The main control part 101 plays a role of controlling each component included in the controller 100, and gives a command to each component of the controller 100. The main control part 101 controls the input/output control part 103, and accesses another device via the network I/F 190 and the network. The engine control part 102 controls or drive driving units of the print engine 120, the folding processing engine 130, the fold enhancing processing engine 140, the scanner engine 150, and the like. The input/output control part 103 inputs, to the main control part 101, a signal or a command that is input via the network I/F 190 and the network.

The image processing part 104 generates drawing information based on document data or image data included in an input print job according to the control by the main control part 101. The drawing information is data such as CMYK bit map data, and is used by the print engine 120 serving as the image forming part to draw an image that should be formed in an image forming operation. The image processing part 104 processes captured image data input from the scanner engine 150 to generate image data. The image data is information to be stored in the image forming apparatus 1 or transmitted to other equipment via the network I/F 190 and the network as a result of a scanner operation. The operation display control part 105 displays information on the display panel 180, or notifies the main control part 101 of information input via the display panel 180.

Subsequently, the following describes an operation example when the folding processing unit 3 and the fold enhancing processing unit 4 according to the embodiment perform folding processing and fold enhancing processing, respectively, with reference to FIGS. 4A to 6C. FIGS. 4A to 6C are cross-sectional views of the folding processing unit 3 and the fold enhancing processing unit 4 viewed from the main-scanning direction when the folding processing unit 3 and the fold enhancing processing unit 4 according to the embodiment perform folding processing and fold enhancing processing, respectively. An operation of each operation part described below is controlled by the main control part 101 and the engine control part 102.

Figure 4A:
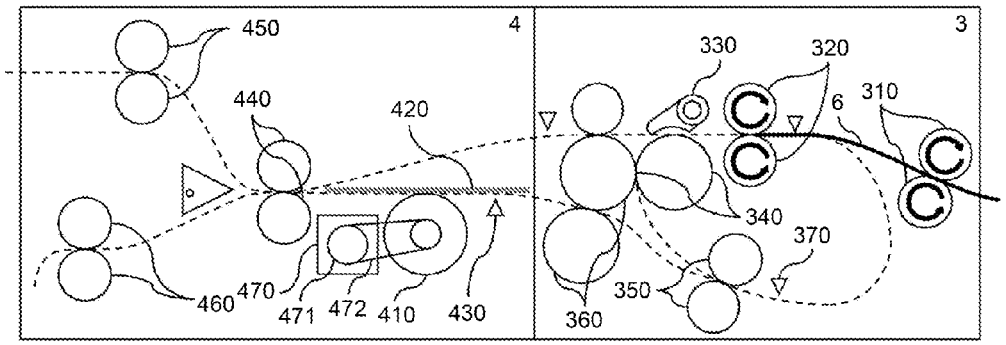
FIGS. 4A to 4C are cross-sectional views of a folding processing unit and a fold enhancing processing unit viewed from a main-scanning direction when the folding processing unit and the fold enhancing processing unit according to the embodiment of the present invention perform folding processing and fold enhancing processing, respectively.

When the image forming apparatus 1 according to the embodiment performs folding processing operation with the folding processing unit 3, as illustrated in FIG. 4A, the folding processing unit 3 first corrects, with a registration roller pair 320, lateral registration of the sheet 6 on which the image is formed and that is conveyed from the image forming unit 2 to the folding processing unit 3 by an inlet roller pair 310, and conveys the sheet 6 toward a conveying path switching claw 330 while adjusting timing of conveyance.

Figure 4B:
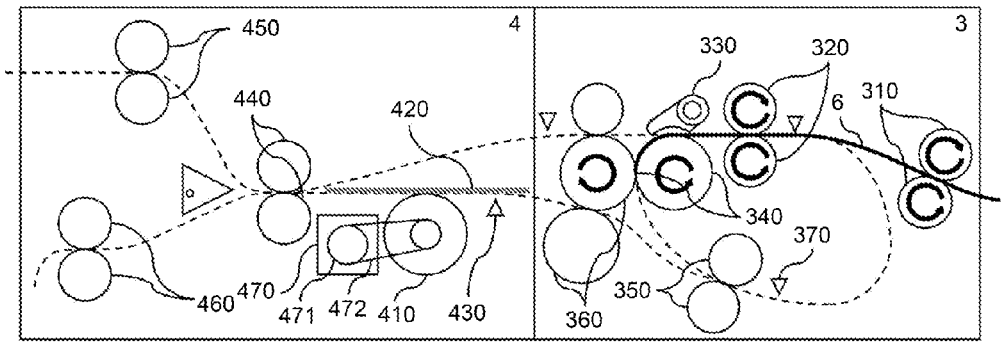
Figure 4C:
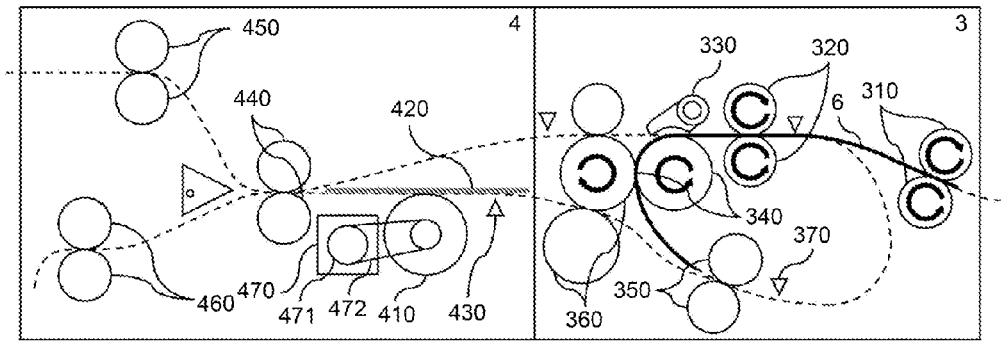

As illustrated in FIG. 4B, the folding processing unit 3 guides, to a first folding processing conveyance roller pair 340, the sheet 6 conveyed through the registration roller pair 320 to the conveying path switching claw 330, using the conveying path switching claw 330. As illustrated in FIG. 4C, the folding processing unit 3 conveys, toward a second folding processing conveyance roller pair 350, the sheet 6 guided by the conveying path switching claw 330 to the first folding processing conveyance roller pair 340, using the first folding processing conveyance roller pair 340.

Figure 5A:
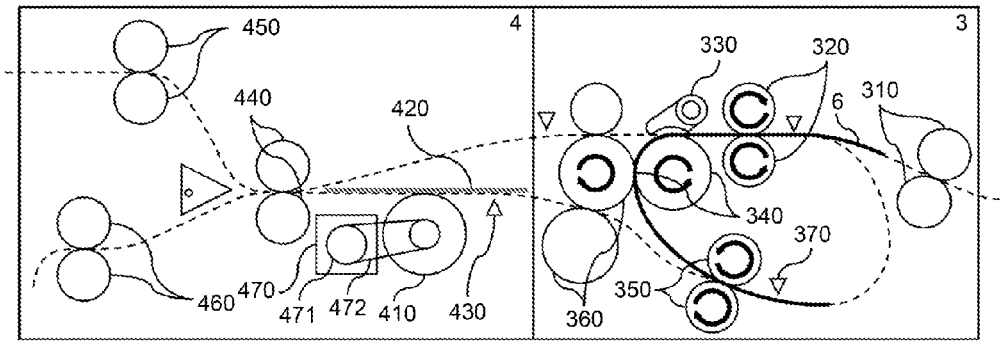
FIGS. 5A to 5C are cross-sectional views of the folding processing unit and the fold enhancing processing unit viewed from the main-scanning direction when the folding processing unit and the fold enhancing processing unit according to the embodiment of the present invention perform folding processing and fold enhancing processing, respectively.
Figure 5B:
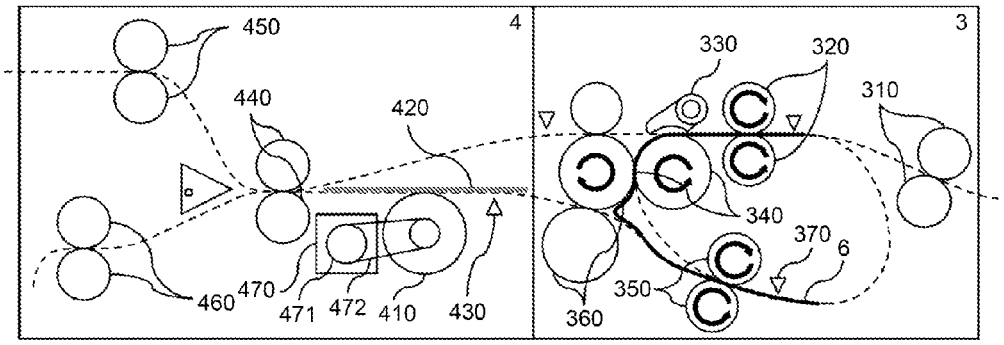

As illustrated in FIG. 5A, in the folding processing unit 3, the first folding processing conveyance roller pair 340 and the second folding processing conveyance roller pair 350 further conveys the sheet 6 conveyed through the first folding processing conveyance roller pair 340 to the second folding processing conveyance roller pair 350. As illustrated in 5B, the folding processing unit 3 creates deflection at a predetermined position of the sheet 6 by reversing a rotational direction of the second folding processing conveyance roller pair 350 while adjusting timing of folding the sheet 6 at the predetermined position, and conveys the sheet 6 toward a fold-forming conveyance roller pair 360 using the first folding processing conveyance roller pair 340 and the second folding processing conveyance roller pair 350 so that a position of the deflection is not changed.

In this case, in the folding processing unit 3, the main control part 101 and the engine control part 102 control each part based on a conveying speed of the sheet 6 and sensor information input from the sensor 370 to adjust the timing.

Figure 5C:
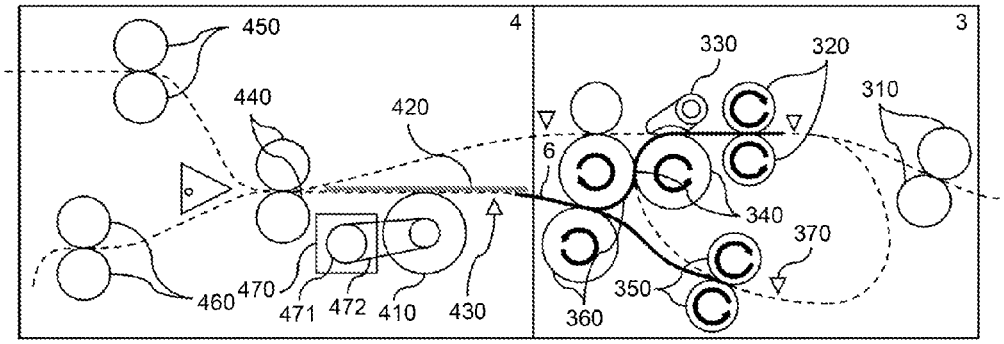

As illustrated in FIG. 5C, the folding processing unit 3 forms a fold at the predetermined position of the sheet 6 conveyed through the second folding processing conveyance roller pair 350 to the fold-forming conveyance roller pair 360 by pinching the deflection of the sheet 6 with the fold-forming conveyance roller pair 360 rotated in the conveying direction, and conveys the sheet 6 toward a gap between a fold enhancing roller 410 and a sheet supporting plate 420 in the fold enhancing processing unit 4. That is, in the embodiment, the fold-forming conveyance roller pair 360 functions as a sheet conveying part. As illustrated in FIGS. 4A to 5C, in the embodiment, one roller of the first folding processing conveyance roller pair 340 also serves as one roller of the fold-forming conveyance roller pair 360.

Figure 7:
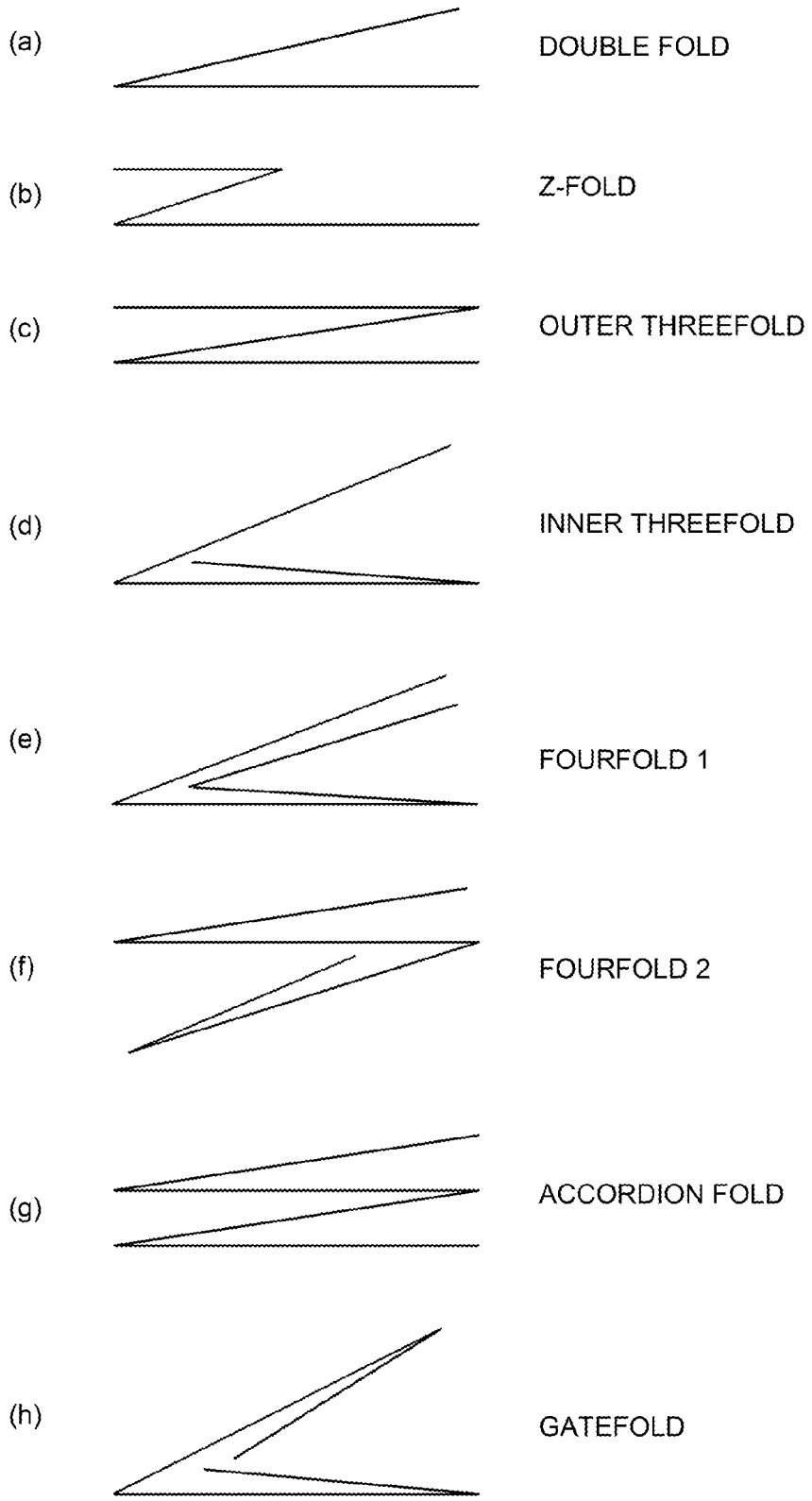
FIG. 7 is a diagram illustrating examples of a shape of a folded sheet on which folding processing is performed by the folding processing unit according to the embodiment of the present invention.

FIG. 7 illustrates examples of a shape of the sheet 6 on which folding processing is performed as described above. FIG. 7 is a diagram illustrating examples of the shape of the folded sheet 6 on which folding processing is performed by the folding processing unit 3 according to the embodiment.

Figure 6A:
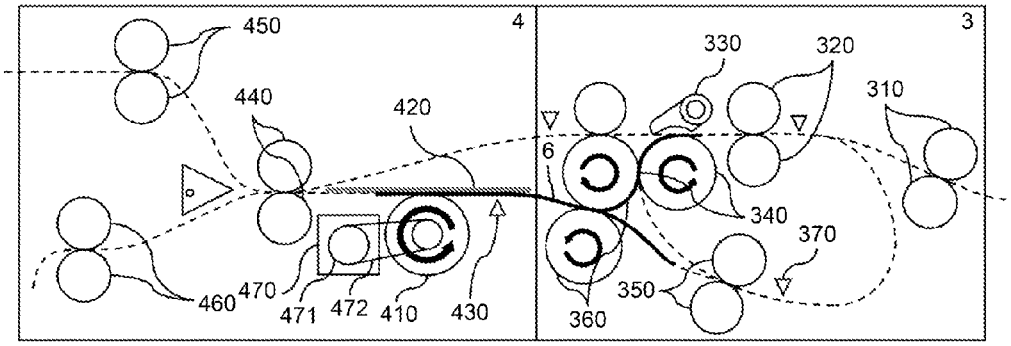
FIGS. 6A to 6C are cross-sectional views of the folding processing unit and the fold enhancing processing unit viewed from the main-scanning direction when the folding processing unit and the fold enhancing processing unit according to the embodiment of the present invention perform folding processing and fold enhancing processing, respectively.

As illustrated in FIG. 6A, the fold enhancing processing unit 4 supports, with the sheet supporting plate 420, the sheet 6 conveyed through the fold-forming conveyance roller pair 360 to the gap between the fold enhancing roller 410 and the sheet supporting plate 420, from a pressing direction, and presses the fold formed on the sheet 6 by rotating the fold enhancing roller 410 in the conveying direction to perform fold enhancing processing. That is, in the embodiment, the fold enhancing roller 410 functions as a pressing part, and the sheet supporting plate 420 functions as a sheet supporting part.

In this case, in the fold enhancing processing unit 4, the main control part 101 and the engine control part 102 control each part based on folding information about a folding method in the folding processing unit 3, sheet information about a size of the sheet 6, a conveying speed of the sheet 6, and a rotational speed of the fold enhancing roller 410 to adjust timing of pressing the sheet 6. Alternatively, in this case, in the fold enhancing processing unit 4, the main control part 101 and the engine control part 102 control each part based on the conveying speed of the sheet 6, the rotational speed of the fold enhancing roller 410, and sensor information input from a sensor 430 to adjust the timing of pressing the sheet 6.

As illustrated in FIGS. 4A to 6C, the fold enhancing roller 410 is driven by a driving force of a fold enhancing roller driving motor 471 transmitted from a fold enhancing roller driving device 470 via a timing belt 472, and the fold-forming conveyance roller pair 360 is driven by a fold-forming conveyance roller driving motor (not illustrated). The driving of the fold enhancing roller driving motor 471 and the fold-forming conveyance roller driving motor are controlled by the engine control part 102. That is, in the embodiment, the fold enhancing roller driving motor 471 functions as a rotation drive braking part, and the engine control part 102 functions as a rotation control part and a conveyance control part.

As described above, the fold enhancing processing unit 4 performs fold enhancing processing by pressing the fold formed on the sheet 6 with the fold enhancing roller 410, and conveys the fold-enhanced sheet 6 toward a fold enhancing processing conveyance roller pair 440.

Figure 6B:
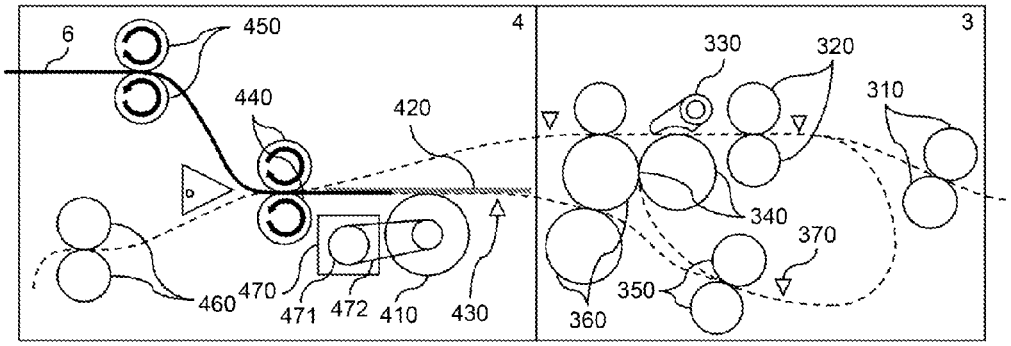

As illustrated in FIG. 6B, to directly eject the fold-enhanced sheet 6 conveyed from the gap between the fold enhancing roller 410 and the sheet supporting plate 420, the fold enhancing processing unit 4 conveys the sheet 6 toward a sheet ejection roller pair 450 with the fold enhancing processing conveyance roller pair 440. The fold enhancing processing unit 4 then ejects, to the sheet ejection tray 170, the fold-enhanced sheet 6 conveyed through the fold enhancing processing conveyance roller pair 440 to the sheet ejection roller 450, with the sheet ejection roller 450. A folding processing operation and a fold enhancing processing operation are then ended in the folding image forming apparatus 1 according to the embodiment.

Figure 6C:
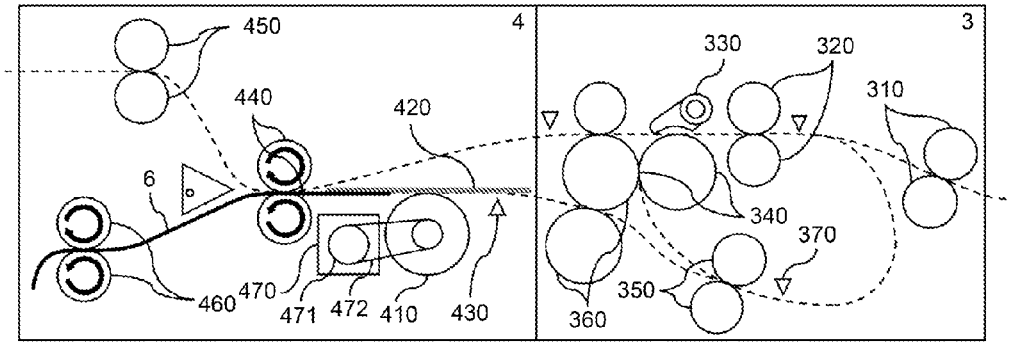

On the other hand, as illustrated in FIG. 6C, to perform postprocessing such as stapling, punching, and bookbinding processing on the fold-enhanced sheet 6 conveyed from the gap between the fold enhancing roller 410 and the sheet supporting plate 420, the fold enhancing processing unit 4 conveys the sheet 6 toward a postprocessing conveyance roller pair 460 with the fold enhancing processing conveyance roller pair 440. The fold enhancing processing unit 4 then conveys, to a postprocessing unit (not illustrated), the fold-enhanced sheet 6 conveyed through the fold enhancing processing conveyance roller pair 440 to the postprocessing conveyance roller pair 460, with the postprocessing conveyance roller pair 460. The folding processing operation and the fold enhancing processing operation are then ended in the folding image forming apparatus 1 according to the embodiment.

Subsequently, the following describes examples of a structure of the fold enhancing roller 410 according to the embodiment with reference to FIGS. 8 to 10, FIGS. 11 to 13, FIGS. 14 to 16, and FIGS. 17 to 19.

Figure 8:
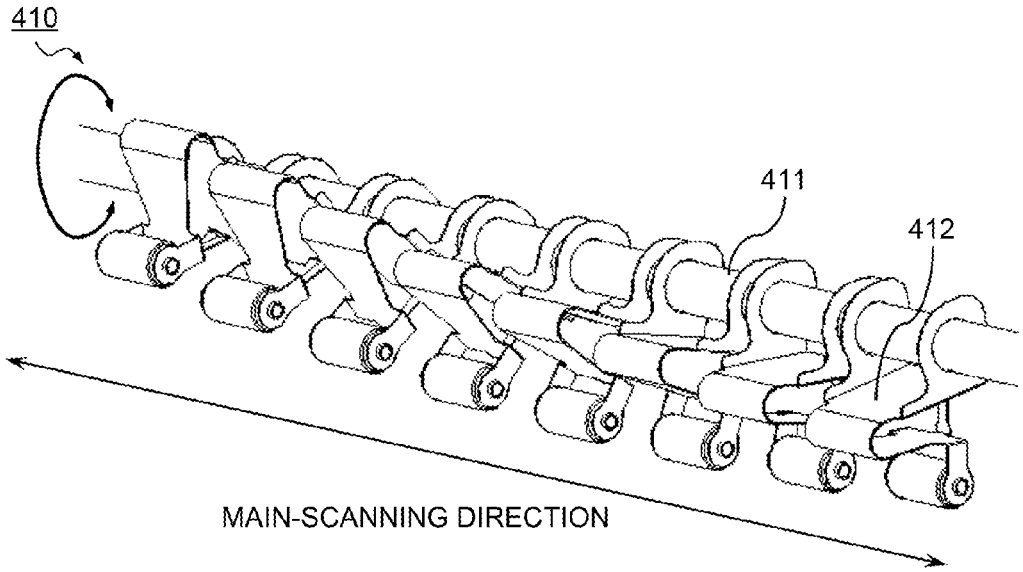
FIG. 8 is a perspective view of a fold enhancing roller according to the embodiment of the present invention viewed from above obliquely to the main-scanning direction.
Figure 9:
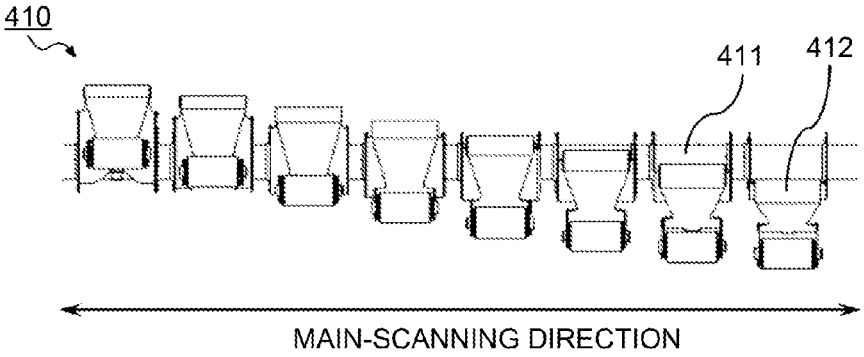
FIG. 9 is a front view of the fold enhancing roller according to the embodiment of the present invention viewed from a sub-scanning direction.
Figure 10:
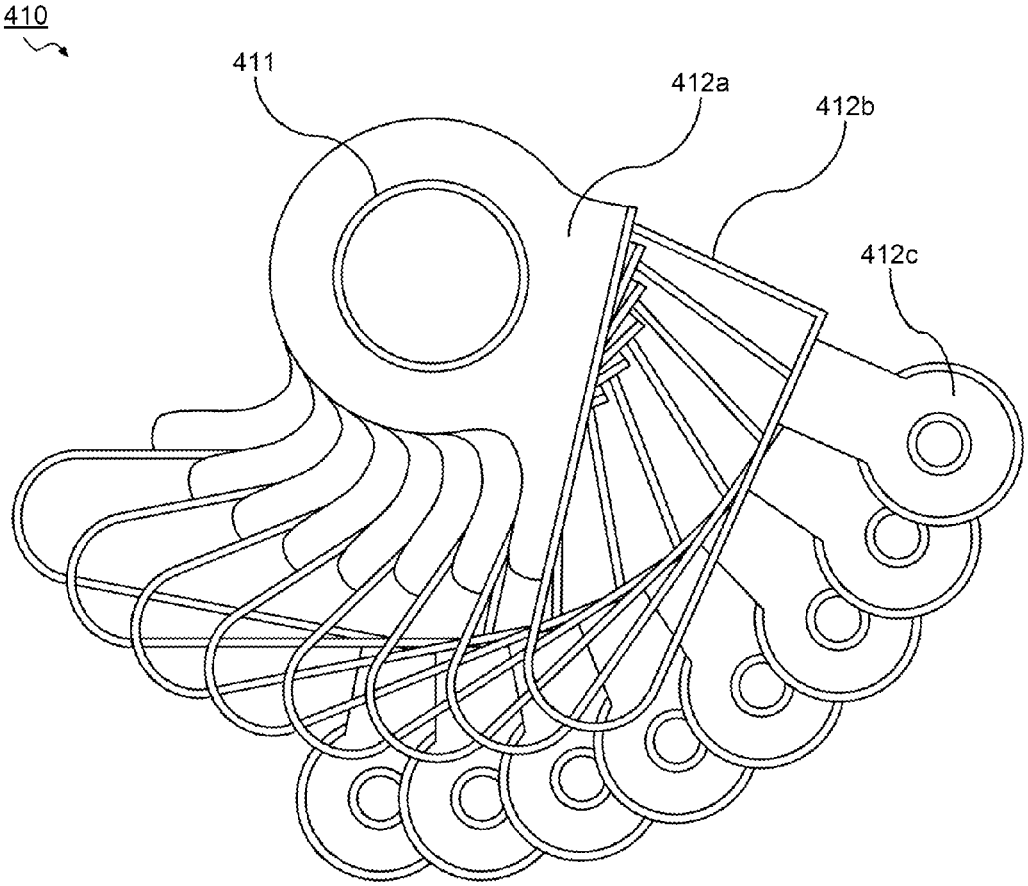
FIG. 10 is a side view of the fold enhancing roller according to the embodiment of the present invention viewed from the main-scanning direction.

The following describes a first example of the structure of the fold enhancing roller 410 according to the embodiment with reference to FIGS. 8 to 10. FIG. 8 is a perspective view of the fold enhancing roller 410 according to the embodiment viewed from above obliquely to the main-scanning direction. FIG. 9 is a front view of the fold enhancing roller 410 according to the embodiment viewed from the sub-scanning direction. FIG. 10 is a side view of the fold enhancing roller 410 according to the embodiment viewed from the main-scanning direction.

As the first example of the structure of the fold enhancing roller 410 according to the embodiment, as illustrated in FIGS. 8 to 10, a plurality of pressing force transmitting parts 412 are arranged at regular intervals around a fold enhancing roller rotating shaft 411 in the main-scanning direction and to have certain angle differences from each other in the rotational direction of the fold enhancing roller rotating shaft 411.

In this case, the fold enhancing roller rotating shaft 411 is a rotating shaft of the fold enhancing roller 410 that is laterally bridged in the main-scanning direction of the fold enhancing processing unit 4 and rotates about an axis along the main-scanning direction. The pressing force transmitting part 412 is a pressing member that expands and contracts in a certain direction to transmit the pressing force to the fold formed on the sheet 6 using an elastic force caused by expansion and contraction.

When the fold enhancing roller 410 according to the embodiment is configured as illustrated in FIGS. 8 to 10, the fold enhancing roller 410 can successively press the fold from one end toward the other end, so that a folding wrinkle can be prevented from being formed.

Figure 11:
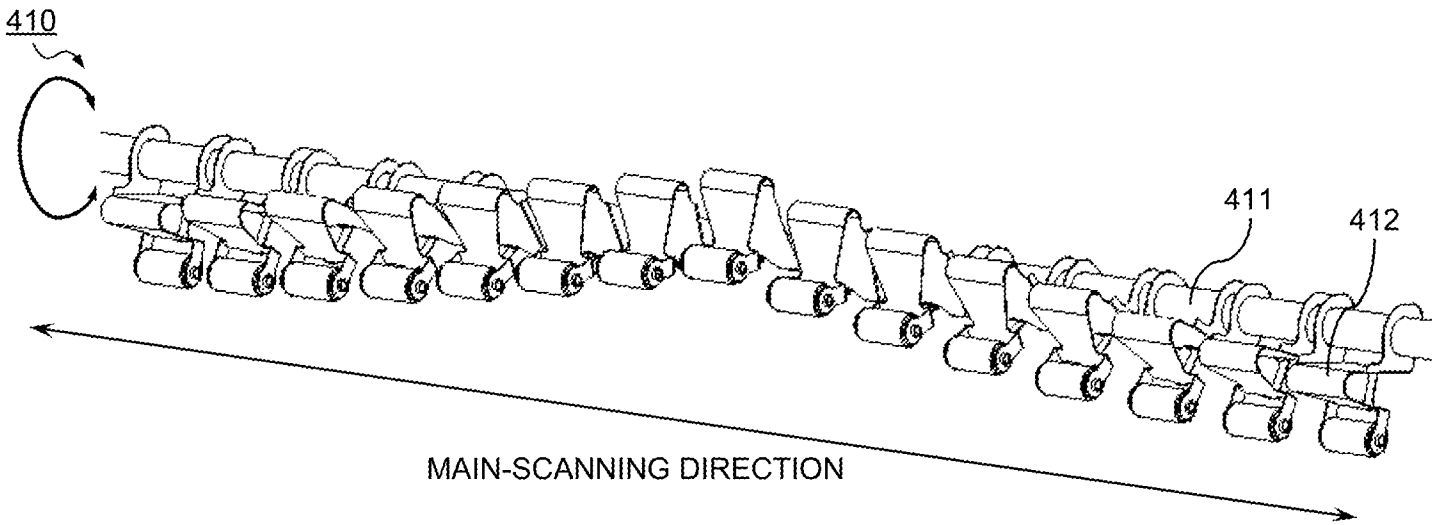
FIG. 11 is a perspective view of the fold enhancing roller according to the embodiment of the present invention viewed from above obliquely to the main-scanning direction.
Figure 12:
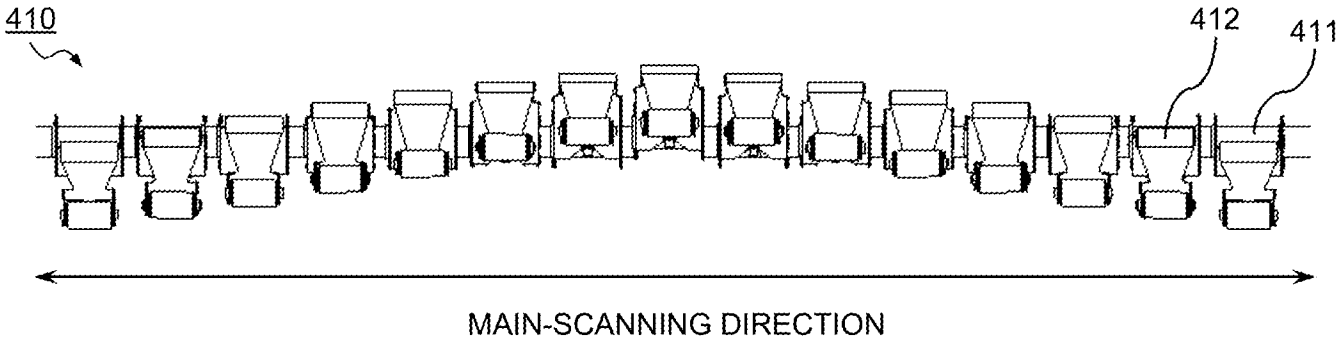
FIG. 12 is a front view of the fold enhancing roller according to the embodiment of the present invention viewed from the sub-scanning direction.
Figure 13:
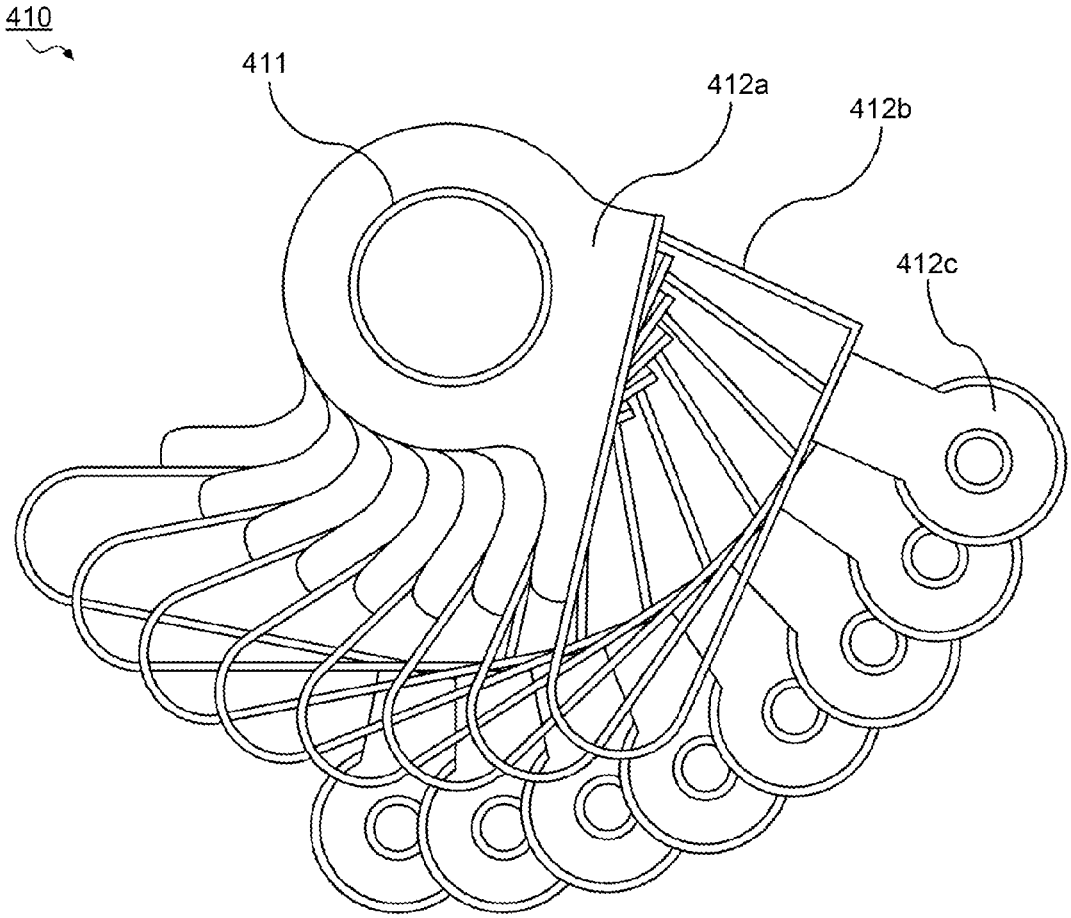
FIG. 13 is a side view of the fold enhancing roller according to the embodiment of the present invention viewed from the main-scanning direction.

Subsequently, the following describes a second example of the structure of the fold enhancing roller 410 according to the embodiment with reference to FIGS. 11 to 13. FIG. 11 is a perspective view of the fold enhancing roller 410 according to the embodiment viewed from above obliquely to the main-scanning direction. FIG. 12 is a front view of the fold enhancing roller 410 according to the embodiment viewed from the sub-scanning direction. FIG. 13 is a side view of the fold enhancing roller 410 according to the embodiment viewed from the main-scanning direction.

As the second example of the structure of the fold enhancing roller 410 according to the embodiment, as illustrated in FIGS. 11 to 13, an odd number of pressing force transmitting parts 412 are arranged at regular intervals around the fold enhancing roller rotating shaft 411 in the main-scanning direction and to have certain angle differences from each other in the rotational direction of the fold enhancing roller rotating shaft 411 such that the pressing force transmitting parts 412 are symmetrically arranged with respect to the center of the fold enhancing roller rotating shaft 411 in the main-scanning direction.

Figure 14:
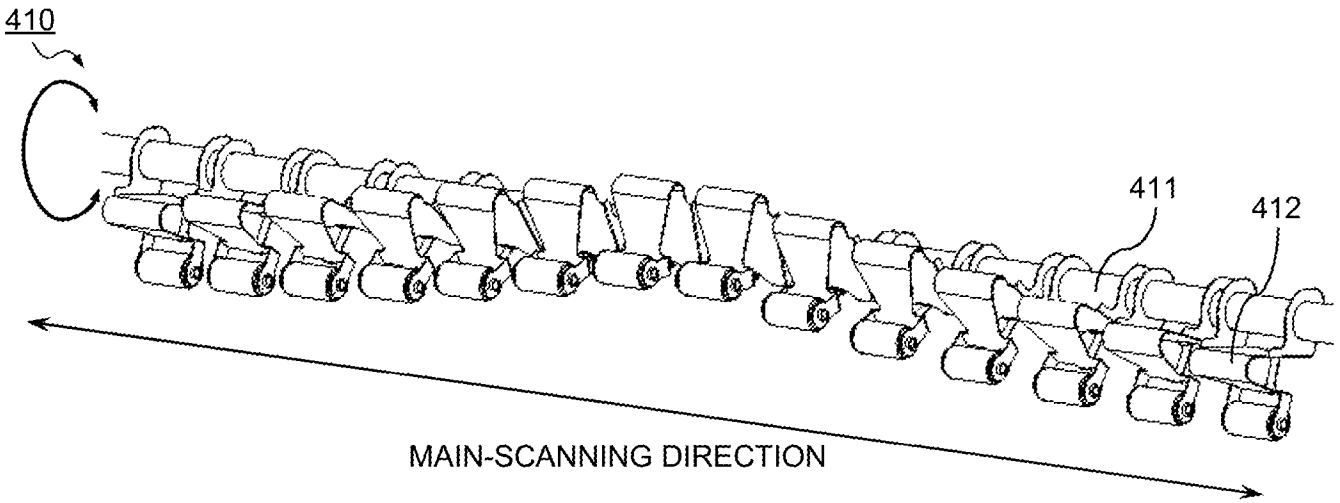
FIG. 14 is a perspective view of the fold enhancing roller according to the embodiment of the present invention viewed from above obliquely to the main-scanning direction.
Figure 15:
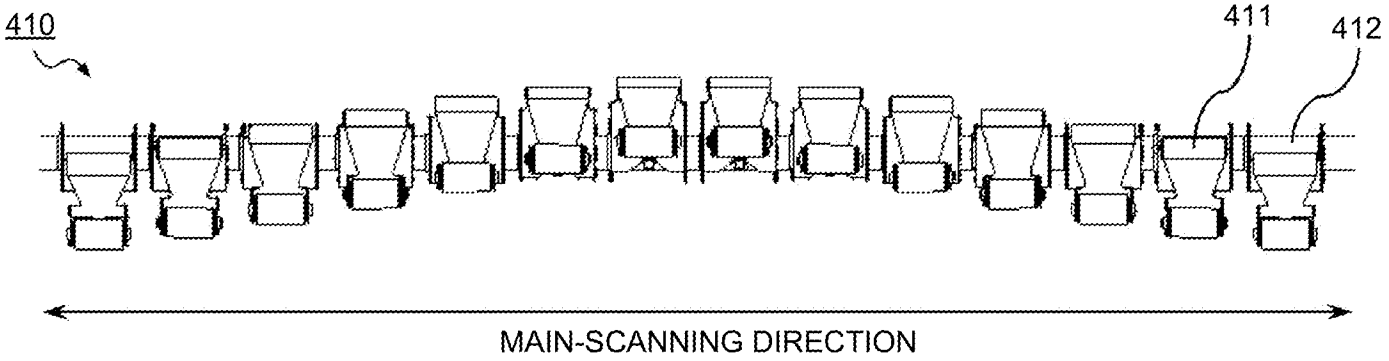
FIG. 15 is a front view of the fold enhancing roller according to the embodiment of the present invention viewed from the sub-scanning direction.
Figure 16:
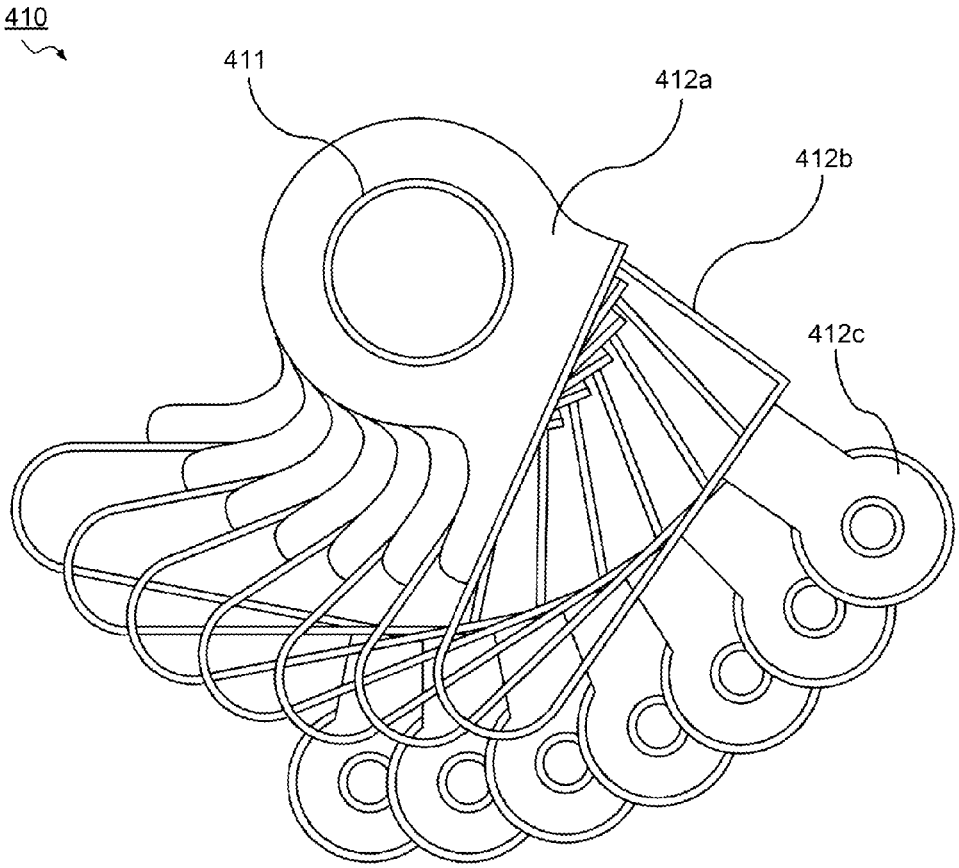
FIG. 16 is a side view of the fold enhancing roller according to the embodiment of the present invention viewed from the main-scanning direction.

Subsequently, the following describes a third example of the structure of the fold enhancing roller 410 according to the embodiment with reference to FIGS. 14 to 16. FIG. 14 is a perspective view of the fold enhancing roller 410 according to the embodiment viewed from above obliquely to the main-scanning direction. FIG. 15 is a front view of the fold enhancing roller 410 according to the embodiment viewed from the sub-scanning direction. FIG. 16 is a side view of the fold enhancing roller 410 according to the embodiment viewed from the main-scanning direction.

As the third example of the structure of the fold enhancing roller 410 according to the embodiment, as illustrated in FIGS. 14 to 16, an even number of pressing force transmitting parts 412 are arranged at regular intervals around the fold enhancing roller rotating shaft 411 in the main-scanning direction and to have certain angle differences from each other in the rotational direction of the fold enhancing roller rotating shaft 411 such that the pressing force transmitting parts 412 are symmetrically arranged with respect to the center of the fold enhancing roller 410 in the main-scanning direction.

Figure 17:
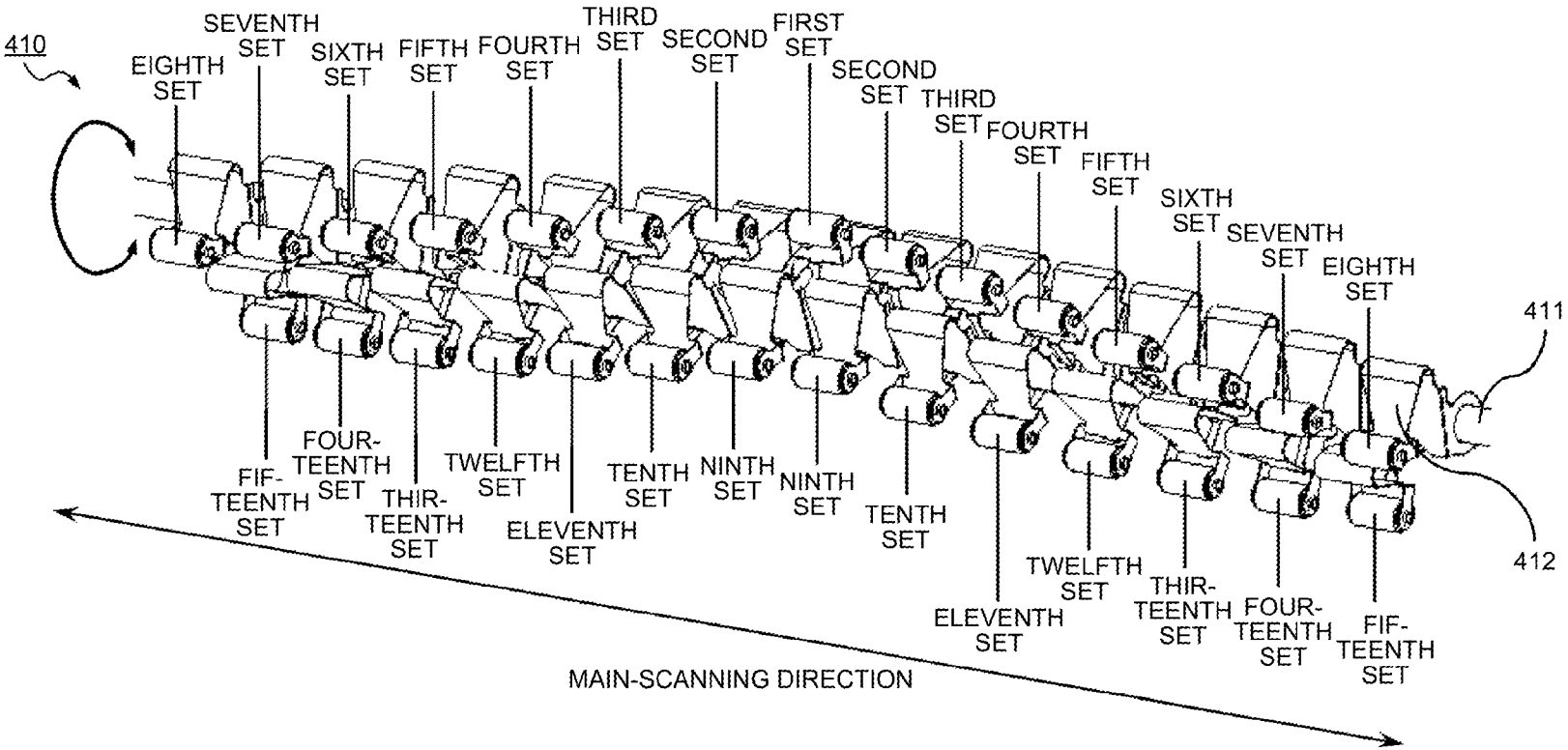
FIG. 17 is a perspective view of the fold enhancing roller according to the embodiment of the present invention viewed from above obliquely to the main-scanning direction.
Figure 18:
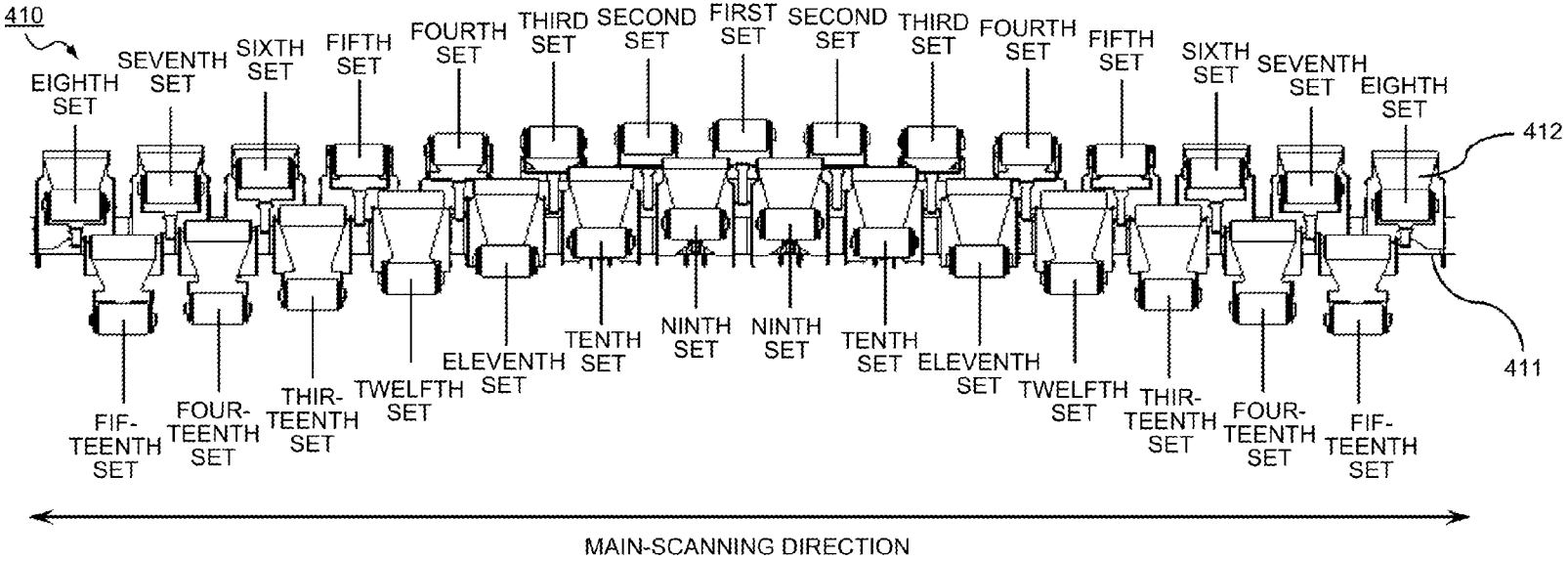
FIG. 18 is a front view of the fold enhancing roller according to the embodiment of the present invention viewed from the sub-scanning direction.
Figure 19:
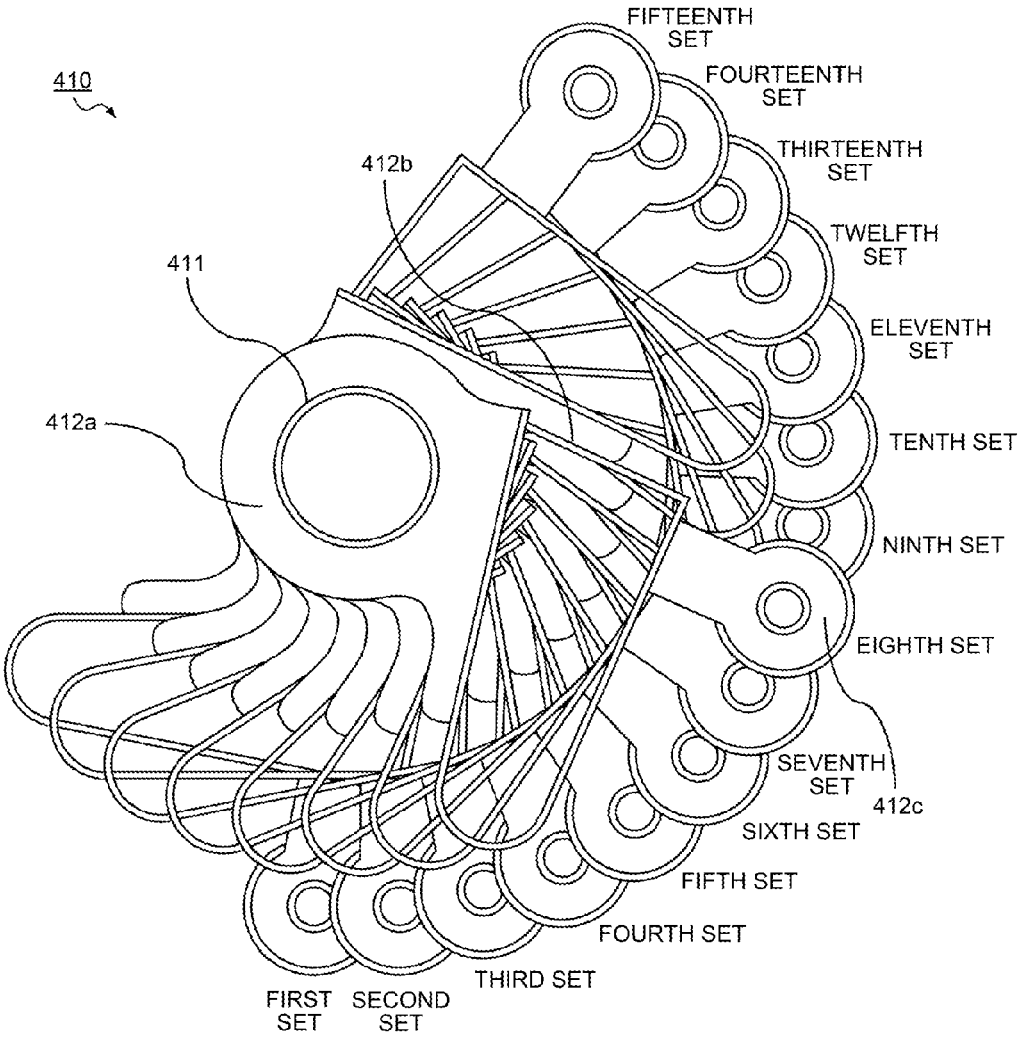
FIG. 19 is a side view of the fold enhancing roller according to the embodiment of the present invention viewed from the main-scanning direction.

Subsequently, the following describes a fourth example of the structure of the fold enhancing roller 410 according to the embodiment with reference to FIGS. 17 to 19. FIG. 17 is a perspective view of the fold enhancing roller 410 according to the embodiment viewed from above obliquely to the main-scanning direction. FIG. 18 is a front view of the fold enhancing roller 410 according to the embodiment viewed from the sub-scanning direction. FIG. 19 is a side view of the fold enhancing roller 410 according to the embodiment viewed from the main-scanning direction.

As the fourth example of the structure of the fold enhancing roller 410 according to the embodiment, as illustrated in FIGS. 17 to 19, an arrangement form of the pressing force transmitting parts 412 on the fold enhancing roller rotating shaft illustrated in FIGS. 11 to 13 and an arrangement form of the pressing force transmitting parts 412 on the fold enhancing roller rotating shaft illustrated in FIGS. 14 to 16 are combined to have certain angle differences from each other in the rotational direction of the fold enhancing roller rotating shaft 411. When the fold enhancing roller 410 according to the embodiment is configured as illustrated in FIGS. 17 to 19, the fold enhancing roller 410 can press the fold without a gap in the main-scanning direction, that is, press the entire fold formed on the sheet 6 without a gap.

When the fold enhancing roller 410 according to the embodiment is configured as illustrated in FIGS. 11 to 13, FIGS. 14 to 16, and FIGS. 17 to 19, the fold enhancing roller 410 can successively press the fold from the center toward both ends, so that a folding wrinkle can be prevented from being formed.

Figure 20A:
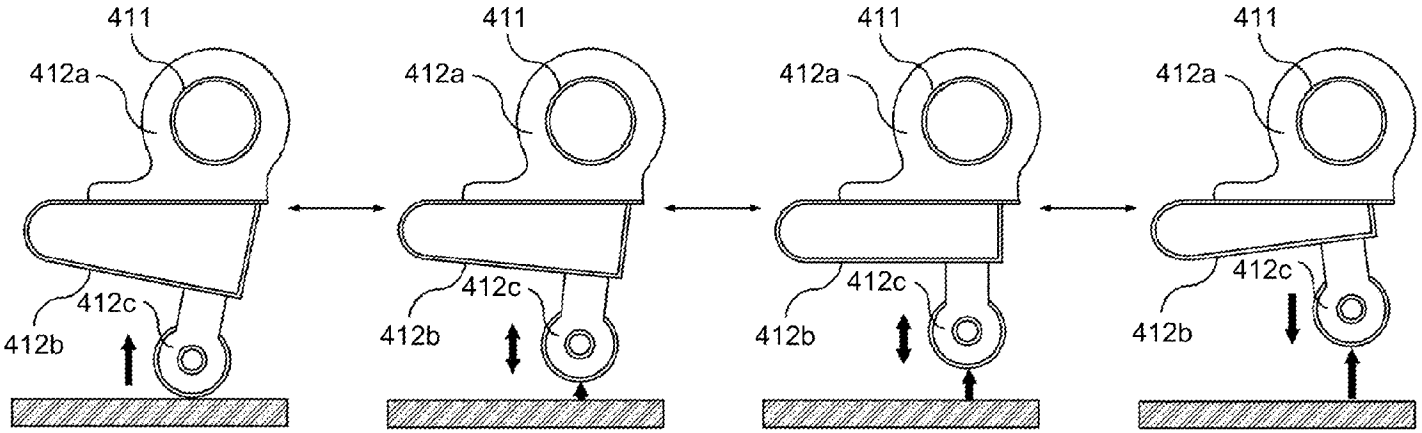
FIGS. 20A and 20B are diagrams illustrating a pressing force transmitting part according to the embodiment of the present invention viewed from the main-scanning direction in a state of being arranged on a fold enhancing roller rotating shaft.
Figure 20B:
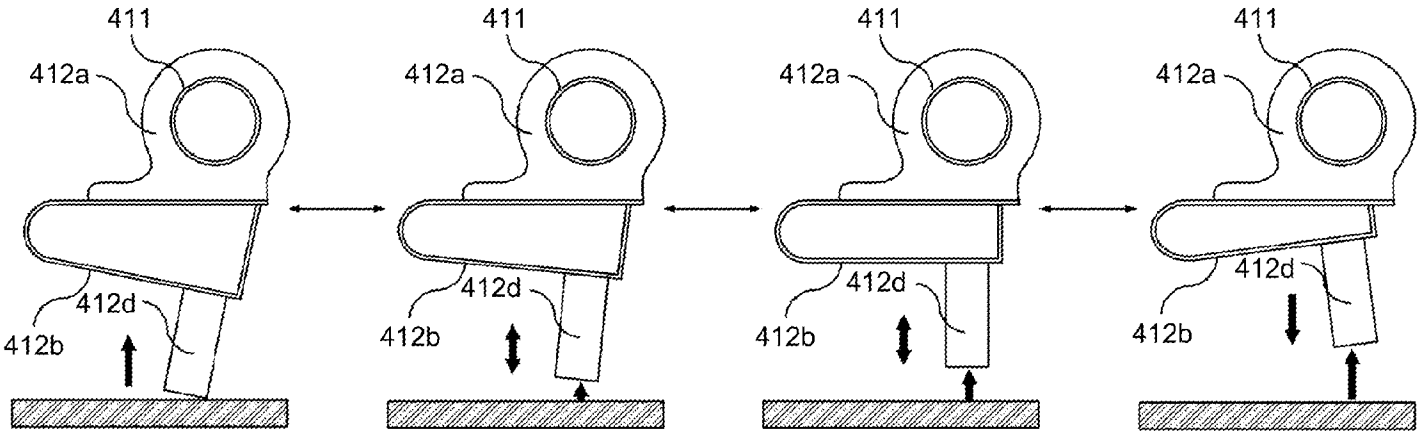

Subsequently, the following describes an example of the structure of the pressing force transmitting part 412 with reference to FIGS. 20A and 20B. FIGS. 20A and 20B are diagrams illustrating the pressing force transmitting part 412 according to the embodiment viewed from the main-scanning direction in a state of being arranged on the fold enhancing roller rotating shaft 411. As illustrated in FIG. 20A, the pressing force transmitting part 412 according to the embodiment includes a fixing part 412*a* for fixing the pressing force transmitting part 412 around the fold enhancing roller rotating shaft 411, an elastic body 412*b* that is attached to the fixing part 412*a* and expands/contracts to generate an elastic force in an expanding/contracting direction, and a pressing roller 412*c* that is attached to the elastic body 412*b* and configured with a rotating body that rotate about an axis along the main-scanning direction. That is, in the embodiment, the pressing roller 412*c* functions as a pressing force exerting part.

A reason why the pressing force transmitting part 412 includes the elastic body 412*b* is that, if the elastic body 412*b* is assumed to be a rigid body, the fold enhancing roller 410 cannot rotate when any of the pressing force transmitting parts 412 abuts on the sheet supporting plate 420. That is, in the embodiment, the elastic body 412*b* functions as an elastic body, a physical shape of which is changed to generate an elastic force corresponding to a change amount.

FIG. 20A illustrates an example in which the elastic body 412*b* is configured with a leaf spring. Alternatively, the elastic body 412*b* may be configured by utilizing elasticity of a compression spring, rubber, a sponge, plastic resin, or the like.

In fold enhancing processing, the fold enhancing processing unit 4 according to the embodiment causes the fold enhancing roller 410 configured as described above to rotate using the fold enhancing roller rotating shaft 411 as a rotation axis to successively press the fold formed on the sheet in the main-scanning direction using each pressing force transmitting part 412 toward a fold direction.

This is because, in the fold enhancing roller 410 according to the embodiment, the pressing force transmitting parts 412 are arranged at regular intervals in the main-scanning direction around the fold enhancing roller rotating shaft 411 and to have certain angle differences from each other in the rotational direction of the fold enhancing roller rotating shaft 411.

Accordingly, the pressing force of the fold enhancing processing unit 4 according to the embodiment is not dispersed across the entire main-scanning direction in fold enhancing processing, and an intensive pressing force from each pressing force transmitting part 412 can be applied to the entire fold.

As illustrated in FIG. 20B, a simple pressing rod 412*d* may be attached to the elastic body 412*b* instead of the pressing roller 412*c* configured with the rotating body. If the pressing force transmitting part 412 is thus configured, the pressing rod 412*d* may damage the sheet 6 in a pressing process, and a portion of the pressing rod 412*d* abutting on the sheet 6 may be severely worn. However, the above problem is relieved when the portion of the pressing rod 412*d* abutting on the sheet 6 is made smooth and a frictional force of the portion abutting on the sheet 6 is made small.

The fold enhancing processing unit 4 according to the embodiment causes the fold enhancing roller 410 configured as described above to rotate using the fold enhancing roller rotating shaft 411 as a rotation axis to successively press the fold formed in the main-scanning direction using each pressing force transmitting part 412 in a direction of the fold.

Accordingly, in the fold enhancing processing unit 4 according to the embodiment can intensively apply the pressing force of each pressing force transmitting part 412 to the entire fold in a short time. Due to this processing, the fold enhancing processing unit 4 according to the embodiment can apply a sufficient pressing force to the fold while reducing a load on the fold enhancing roller rotating shaft 411 without lowering productivity. Accordingly, it is possible to provide a fold enhancing device the productivity of which is high, the size of which is small, and the cost of which is low.

Subsequently, the following describes details about an operation example in which the fold enhancing processing unit 4 according to the embodiment performs fold enhancing processing with reference to FIGS. 21A to 21E. FIGS. 21A to 21E are cross-sectional views only of a mechanism related to the fold enhancing processing in the fold enhancing processing unit 4 viewed from the main-scanning direction when the fold enhancing processing unit 4 according to the embodiment performs fold enhancing processing. With reference to FIGS. 21A to 21E, the following describes an example in which fold enhancing processing is performed on the sheet 6 on which a z-fold including a first fold 6*a* is formed. An operation of each operation part described below is controlled by the main control part 101 and the engine control part 102.

Figure 21A:
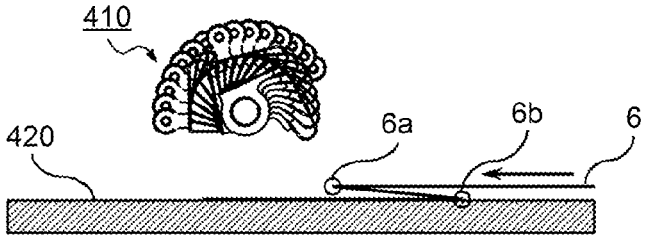
FIGS. 21A to 21E are cross-sectional views only of a mechanism related to fold enhancing processing in the fold enhancing processing unit viewed from the main-scanning direction when the fold enhancing processing unit according to the embodiment of the present invention performs fold enhancing processing.
Figure 21B:
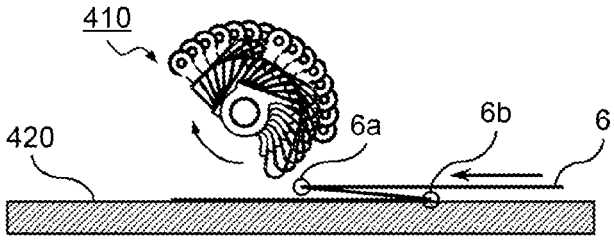

In the fold enhancing processing unit 4 according to the embodiment, when the sheet 6 is started to be conveyed as illustrated in FIG. 21A, the fold enhancing roller 410 is started to be rotated after calculating timing when the fold enhancing roller 410 abuts on the first fold 6*a* formed on the sheet 6 as illustrated in FIG. 21B.

In this case, in the fold enhancing processing unit 4, the main control part 101 and the engine control part 102 control each part based on the folding information about the folding method in the folding processing unit 3, the sheet information about the size of the sheet 6, the conveying speed of the sheet 6, and the rotational speed of the fold enhancing roller 410 to calculate the timing when the fold enhancing roller 410 abuts on the first fold 6*a* formed on the sheet 6. Alternatively, in this case, in the fold enhancing processing unit 4, the main control part 101 and the engine control part 102 control each part based on the conveying speed of the sheet 6, the rotational speed of the fold enhancing roller 410, and the sensor information input from the sensor 430 to calculate the timing when the fold enhancing roller 410 abuts on the first fold 6*a* formed on the sheet 6.

Figure 21C:
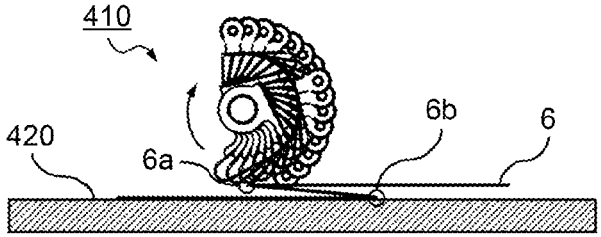
Figure 21D:
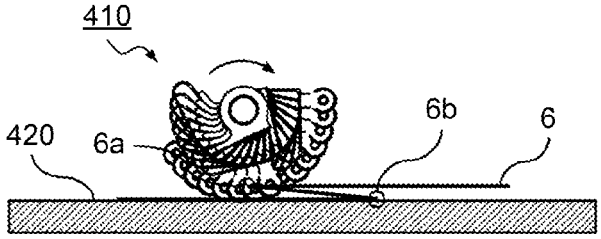

As illustrated in FIG. 21C, the fold enhancing processing unit 4 conveys the sheet 6 until the first fold 6*a* is positioned immediately below the fold enhancing roller rotating shaft 411 and completely stops conveying the sheet 6. When the fold enhancing roller 410 starts to abut on the first fold 6*a* formed on the sheet 6, the fold enhancing processing unit 4 starts to press the first fold 6*a*. As illustrated in FIG. 21D, the fold enhancing processing unit 4 continues to rotate the fold enhancing roller 410 while stopping the sheet 6 to continue to press the first fold 6*a* formed on the sheet 6.

Figure 22A:
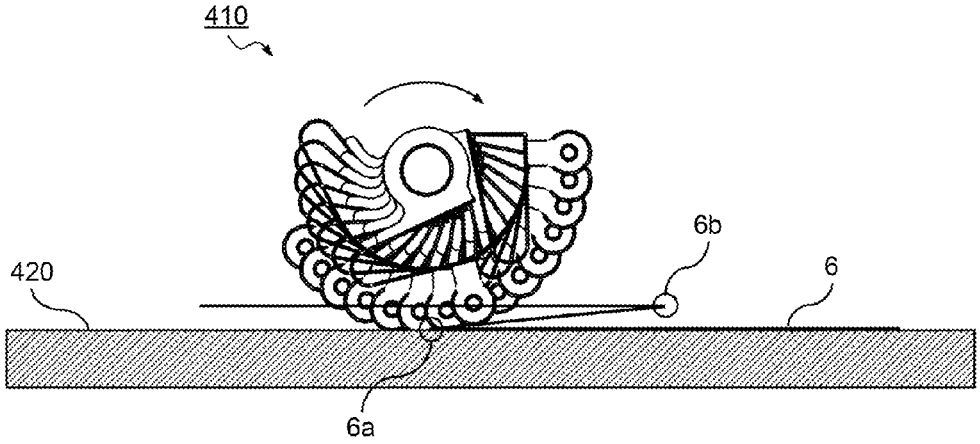
FIGS. 22A to 22C are diagrams illustrating a state in which a conventional fold enhancing processing unit presses a sheet folded such that a first fold is positioned between a front end and a rear end in a conveying direction, from a surface opposite to a surface on which the fold is formed.
Figure 22B:
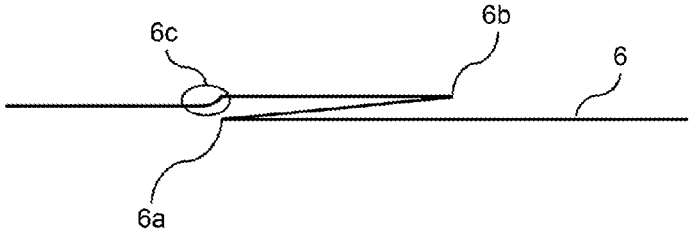
Figure 22C:
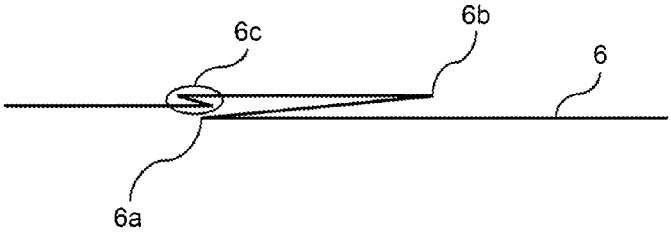

At this time, one of the main points of the fold enhancing processing unit 4 according to the embodiment is to press the sheet 6 that is folded such that the first fold 6*a* is positioned between the front end and the rear end in the conveying direction, from the surface on which the first fold 6*a* is formed. In this case, the following describes a significance of that the fold enhancing processing unit 4 according to the embodiment presses the sheet 6 that is folded such that the first fold 6*a* is positioned between the front end and the rear end in the conveying direction, from the surface on which the first fold 6*a* is formed, with reference to FIGS. 22A to 22C. FIGS. 22A to 22C are diagrams illustrating a state in which a conventional fold enhancing processing unit presses the sheet 6 that is folded such that the first fold 6*a* is positioned between the front end and the rear end in the conveying direction, from a surface opposite to the surface on which the first fold 6*a* is formed.

As illustrated in FIG. 22A, when the conventional fold enhancing processing unit presses the sheet 6 that is folded such that the first fold 6*a* is positioned between the front end and the rear end in the conveying direction, from the surface opposite to the surface on which the first fold 6*a* is formed, a pressed mark 6*c* or a folding wrinkle 6*d* is formed on the sheet 6 due to a thickness of the first fold 6*a* as illustrated in FIGS. 22B and 22C.

Accordingly, one of objects of the fold enhancing processing unit 4 according to the embodiment is to prevent the pressed mark 6*c* or the folding wrinkle 6*d* from being formed on the sheet 6 in this way. As described above, the fold enhancing processing unit 4 according to the embodiment is therefore configured to press the sheet 6 that is folded such that the first fold 6*a* is positioned between the front end and the rear end in the conveying direction, from the surface on which the first fold 6*a* is formed.

The fold enhancing processing unit 4 according to the embodiment is configured as described above, so that a folding wrinkle, a pressed mark, and the like can be prevented from being formed on the sheet 6 after fold enhancing processing. Accordingly, the fold enhancing processing unit 4 according to the embodiment can improve quality of the sheet 6 after enhancing the fold thereof.

In this case, in the fold enhancing processing unit 4, the main control part 101 and the engine control part 102 control each part based on the folding information about the folding method in the folding processing unit 3 to convey the sheet 6 to a position at which fold enhancing processing is performed such that the sheet 6 is pressed from the surface on which the first fold 6*a* is formed.

Figure 21E:
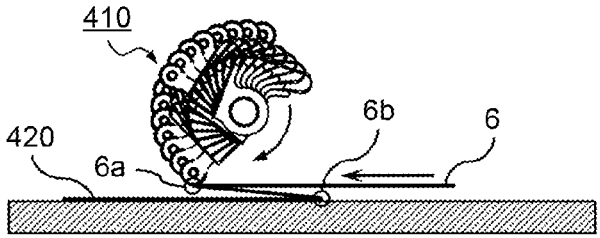

Thereafter, as illustrated in FIG. 21E, the fold enhancing processing unit 4 calculates timing when the fold enhancing roller 410 is separated from the sheet 6, and starts to convey the sheet 6 at the time when the fold enhancing roller 410 is separated from the sheet 6.

In this case, in the fold enhancing processing unit 4, the main control part 101 and the engine control part 102 control each part based on the rotational speed of the fold enhancing roller 410 to calculate the timing when the fold enhancing roller 410 is separated from the sheet 6.

The fold enhancing processing unit 4 then conveys the sheet 6 separated from the fold enhancing roller 410 without pressing a fold 6*b* to end the fold enhancing processing. In this way, the fold enhancing processing unit 4 conveys the sheet 6 separated from the fold enhancing roller 410 without pressing the fold 6*b* because the fold 6*b* cannot be pressed from the side on which the fold is located. If the fold enhancing processing unit 4 is configured such that the fold enhancing rollers 410 are arranged over and under the sheet supporting plate 420, the fold 6*b* can also be pressed from the side on which the fold is located similarly to the fold 6*a*.

As illustrated in FIGS. 21A to 21E, the fold enhancing processing unit 4 according to the embodiment is configured such that, in pressing the sheet 6 that is folded such that the first fold 6*a* is positioned between the front end and the rear end in the conveying direction, the sheet 6 is pressed from the surface on which the first fold 6*a* is formed. This configuration is one of the main points of the fold enhancing processing unit 4 according to the embodiment. Due to such a configuration, the fold enhancing processing unit 4 according to the embodiment can prevent a folding wrinkle, a pressed mark, and the like from being formed on the sheet 6 after fold enhancing processing. Accordingly, the fold enhancing processing unit 4 according to the embodiment can improve the quality of the sheet 6 after enhancing the fold thereof.

If the fold enhancing roller 410 rotates in a direction opposite to that in the example illustrated in FIGS. 21A to 21E, the fold enhancing roller 410 first collides against the sheet supporting plate 420 at the timing corresponding to FIG. 21C and then abuts on the sheet 6. Accordingly, if the fold enhancing roller 410 rotates in the direction opposite to that in the example illustrated in FIGS. 21A to 21E, sound of collision between the fold enhancing roller 410 and the sheet supporting plate 420 is generated in the fold enhancing processing unit 4.

On the other hand, in the example illustrated in FIGS. 21A to 21E, the fold enhancing roller 410 abuts only on the sheet 6, and indirectly collides against the sheet supporting plate 420 via the sheet 6. Accordingly, in the example illustrated in FIGS. 21A to 21E, the sheet 6 functions as a buffer between the fold enhancing roller 410 and the sheet supporting plate 420, so that the collision sound as described above can be suppressed. Specifically, such an effect can be easily obtained as the number of folding processes of the sheet 6 increases. This is because overlaps of the sheet increase as the number of folding processes of the sheet 6 increases, so that the thickness of the sheet is increased and a buffer effect is enhanced.

If the fold enhancing roller 410 rotates in the direction opposite to that in the example illustrated in FIGS. 21A to 21E, the fold enhancing roller 410 first collides against the sheet supporting plate 420 at the timing corresponding to FIG. 21C and then abuts on the sheet 6. In this case, the fold enhancing roller 410 abuts toward an opening part formed over the first fold 6*a*. Accordingly, if the fold enhancing roller 410 rotates in the direction opposite to the example illustrated in FIGS. 21A to 21E, a folding wrinkle may be formed on the sheet 6. Specifically, such a problem tends to be conspicuously caused as the number of folding processes of the sheet 6 increases. This is because overlaps of the sheet increase as the number of folding processes of the sheet 6 increases, so that the thickness of the sheet is increased.

On the other hand, in the example illustrated in FIGS. 21A to 21E, the fold enhancing roller 410 abuts on the sheet 6 from the opposite side of the opening part formed over the first fold 6*a*. Accordingly, in the example illustrated in FIGS. 21A to 21E, a folding wrinkle is not formed on the sheet 6 regardless of the number of folding processes of the sheet 6.

In this way, the fold enhancing processing unit 4 according to the embodiment can suppress the collision sound and prevent a folding wrinkle from being formed by changing the rotational direction of the fold enhancing roller 410 depending on a paper type and/or a thickness of the sheet 6, the shape, the folding method, the number of folding processes, and/or the position of the fold of the folded sheet 6, and/or the like.

Subsequently, the following describes details about another operation example in which the fold enhancing processing unit 4 according to the embodiment performs fold enhancing processing with reference to FIGS. 23A to 23E. FIGS. 23A to 23E are cross-sectional views only of a mechanism related to fold enhancing processing in the fold enhancing processing unit 4 viewed from the main-scanning direction when the fold enhancing processing unit 4 according to the embodiment performs fold enhancing processing. With reference to FIGS. 23A to 23E, the following describes an example in which fold enhancing processing is performed on the sheet 6 on which a z-fold including the second fold 6*b* is formed. An operation of each operation part described below is controlled by the main control part 101 and the engine control part 102.

Figure 23A:
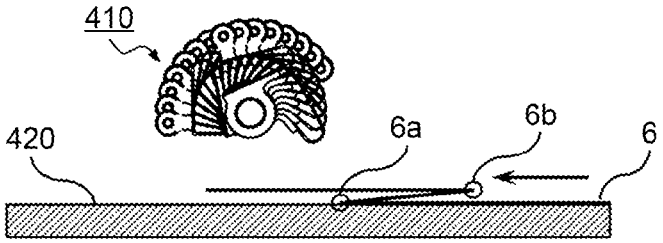
FIGS. 23A to 23E are cross-sectional views only of a mechanism related to fold enhancing processing in the fold enhancing processing unit viewed from the main-scanning direction when the fold enhancing processing unit according to the embodiment of the present invention performs fold enhancing processing.
Figure 23B:
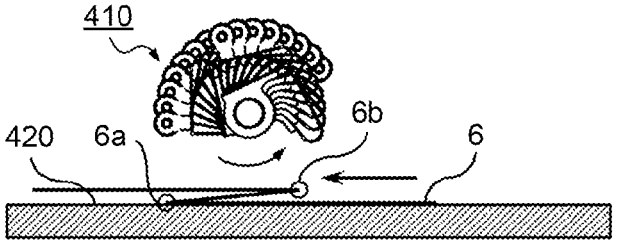

In the fold enhancing processing unit 4 according to the embodiment, when the sheet 6 is started to be conveyed as illustrated in FIG. 23A, the fold enhancing roller 410 is started to be reversely rotated after calculating timing when the fold enhancing roller 410 abuts on the second fold 6*b* formed on the sheet 6 as illustrated in FIG. 23B.

In this case, in the fold enhancing processing unit 4, the main control part 101 and the engine control part 102 control each part based on the folding information about the folding method in the folding processing unit 3, the sheet information about the size of the sheet 6, the conveying speed of the sheet 6, and the rotational speed of the fold enhancing roller 410 to calculate the timing when the fold enhancing roller 410 abuts on the second fold 6*b* formed on the sheet 6. Alternatively, in this case, in the fold enhancing processing unit 4, the main control part 101 and the engine control part 102 control each part based on the conveying speed of the sheet 6, the rotational speed of the fold enhancing roller 410, and the sensor information input from the sensor 430 to calculate the timing when the fold enhancing roller 410 abuts on the second fold 6*b* formed on the sheet 6.

Figure 23C:
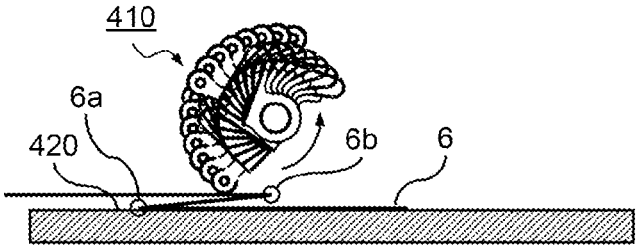
Figure 23D:
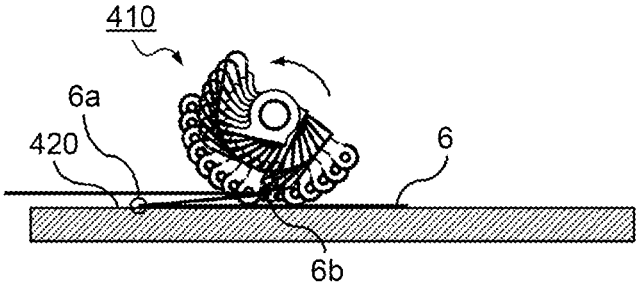

As illustrated in FIG. 23C, the fold enhancing processing unit 4 conveys the sheet 6 until the first fold 6*b* is positioned immediately below the fold enhancing roller rotating shaft 411 and completely stops conveying the sheet 6. When the fold enhancing roller 410 starts to abut on the first fold 6*b* formed on the sheet 6, the fold enhancing processing unit 4 starts to press the first fold 6*a*. As illustrated in FIG. 23D, the fold enhancing processing unit 4 continues to rotate the fold enhancing roller 410 while stopping the sheet 6 to continue to press the first fold 6*a* formed on the sheet 6.

At this time, one of the main points of the fold enhancing processing unit 4 according to the embodiment is to press the sheet 6 that is folded such that the second fold 6*b* is positioned between the front end and the rear end in the conveying direction, from the surface on which the second fold 6*b* is formed. In this way, the fold enhancing processing unit 4 according to the embodiment presses the sheet 6 that is folded such that the second fold 6*b* is positioned between the front end and the rear end in the conveying direction, from the surface on which the second fold 6*b* is formed, a significance of which is the same as described with reference to FIGS. 22A to 22C.

The fold enhancing processing unit 4 according to the embodiment is configured as described above, so that a folding wrinkle, a pressed mark, and the like can be prevented from being formed on the sheet 6 after fold enhancing processing. Accordingly, the fold enhancing processing unit 4 according to the embodiment can improve the quality of the sheet 6 after enhancing the fold thereof.

In this case, in the fold enhancing processing unit 4, the main control part 101 and the engine control part 102 control each part based on the folding information about the folding method in the folding processing unit 3 to convey the sheet 6 to a position at which fold enhancing processing is performed such that the sheet 6 is pressed from the surface on which the second fold 6*b* is formed.

Figure 23E:
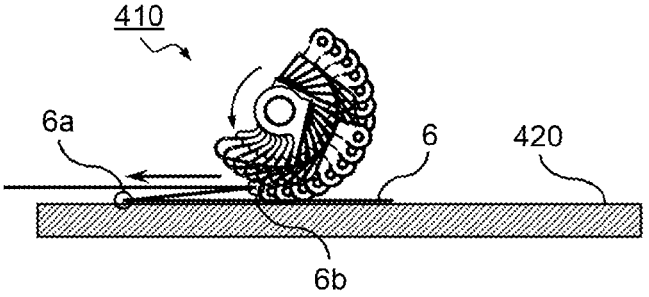

Thereafter, as illustrated in FIG. 23E, the fold enhancing processing unit 4 calculates timing when the fold enhancing roller 410 is separated from the sheet 6, and starts to convey the sheet 6 at the time when the fold enhancing roller 410 is separated from the sheet 6.

In this case, in the fold enhancing processing unit 4, the main control part 101 and the engine control part 102 control each part based on the rotational speed of the fold enhancing roller 410 to calculate the timing when the fold enhancing roller 410 is separated from the sheet 6.

The fold enhancing processing unit 4 then conveys the sheet 6 separated from the fold enhancing roller 410 without pressing the fold 6*a* to end the fold enhancing processing. In this way, the fold enhancing processing unit 4 conveys the sheet 6 separated from the fold enhancing roller 410 without pressing the fold 6*a* because the fold 6*a* cannot be pressed from the side on which the fold is located. If the fold enhancing processing unit 4 is configured such that the fold enhancing rollers 410 are arranged over and under the sheet supporting plate 420, the fold 6*a* can also be pressed from the side on which the fold is located similarly to the fold 6*b*.

As illustrated in FIGS. 23A to 23E, the fold enhancing processing unit 4 according to the embodiment is configured such that, in pressing the sheet 6 that is folded such that the second fold 6*b* is positioned between the front end and the rear end in the conveying direction, the sheet 6 is pressed from the surface on which the second fold 6*b* is formed. This configuration is one of the main points of the fold enhancing processing unit 4 according to the embodiment. Due to such a configuration, the fold enhancing processing unit 4 according to the embodiment can prevent a folding wrinkle, a pressed mark, and the like from being formed on the sheet 6 after fold enhancing processing. Accordingly, the fold enhancing processing unit 4 according to the embodiment can improve the quality of the sheet 6 after enhancing the fold thereof.

If the fold enhancing roller 410 rotates in a direction opposite to that in the example illustrated in FIGS. 23A to 23E, the fold enhancing roller 410 first abuts on a portion where the sheet 6 is not folded at the timing corresponding to FIG. 23C. Accordingly, if the fold enhancing roller 410 rotates in the direction opposite to that in the example illustrated in FIGS. 23A to 23E, a buffer action between the fold enhancing roller 410 and the sheet supporting plate 420 caused by the sheet 6 is weakened in the fold enhancing processing unit 4 to generate the collision sound.

On the other hand, in the example illustrated in FIGS. 23A to 23E, the fold enhancing roller 410 abuts only on a folded portion of the sheet 6, and collides against the sheet supporting plate 420 via the folded portion of the sheet 6. Accordingly, in the example illustrated in FIGS. 23A to 23E, the folded portion of the sheet 6 functions as a buffer between the fold enhancing roller 410 and the sheet supporting plate 420, so that the collision sound as described above can be suppressed. Specifically, such an effect can be easily obtained as the number of folding processes of the sheet 6 increases. This is because overlaps of the sheet increase as the number of folding processes of the sheet 6 increases, so that the thickness of the sheet is increased and the buffer effect is enhanced.

If the fold enhancing roller 410 rotates in the direction opposite to the example illustrated in FIGS. 23A to 23E, the fold enhancing roller 410 first abuts on the portion where the sheet 6 is not folded at the timing corresponding to FIG. 23C. In this case, the fold enhancing roller 410 abuts toward an opening part formed under the second fold 6*b*. Accordingly, if the fold enhancing roller 410 rotates in the direction opposite to that in the example illustrated in FIGS. 23A to 23E, a folding wrinkle may be formed on the sheet 6. Specifically, such a problem tends to be conspicuously caused as the number of folding processes of the sheet 6 increases. This is because overlaps of the sheet increase as the number of folding processes of the sheet 6 increases, so that the thickness of the sheet is increased.

On the other hand, in the example illustrated in FIGS. 23A to 23E, the fold enhancing roller 410 abuts on the sheet 6 from the opposite side of the opening part formed over the second fold 6*b*. Accordingly, in the example illustrated in FIGS. 23A to 23E, a folding wrinkle is not formed on the sheet 6 regardless of the number of folding processes of the sheet 6.

In this way, the fold enhancing processing unit 4 according to the embodiment can suppress the collision sound and prevent a folding wrinkle from being formed by changing the rotational direction of the fold enhancing roller 410 depending on a paper type and/or a thickness of the sheet 6, the shape, the folding method, the number of folding processes, and/or the position of the fold of the folded sheet 6, and/or the like.

Figure 24:
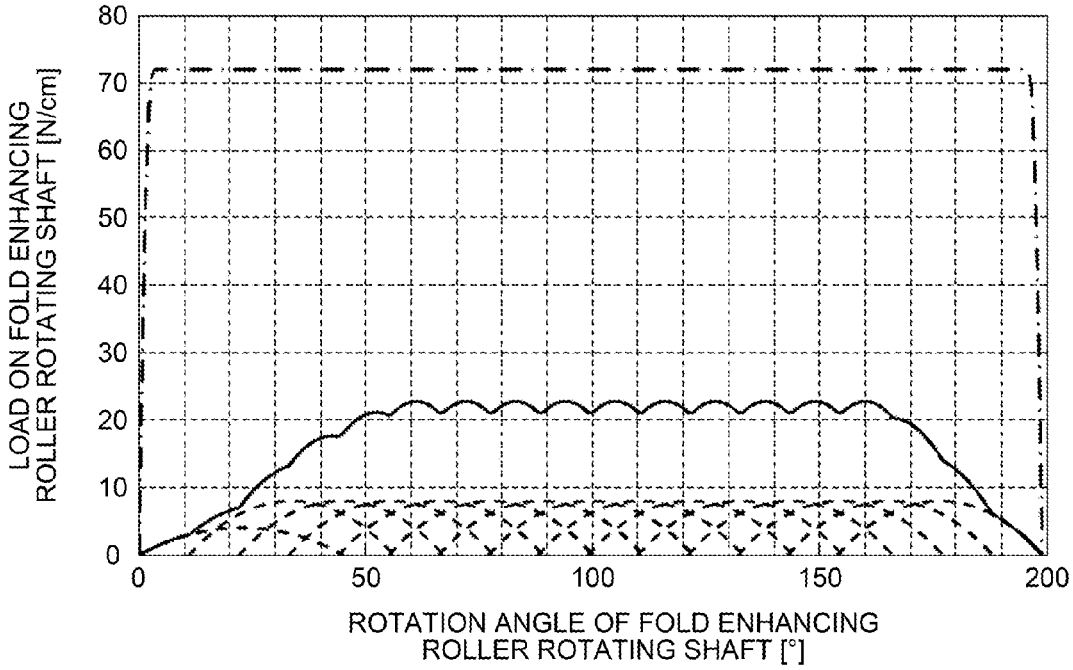
FIG. 24 is a graph illustrating a load on the fold enhancing roller rotating shaft when the fold enhancing processing unit according to the embodiment of the present invention is in a fold enhancing processing operation.

Subsequently, the following describes a load on the fold enhancing roller rotating shaft 411 when the fold enhancing processing unit 4 according to the embodiment is in the fold enhancing processing operation with reference to FIG. 24. FIG. 24 is a graph illustrating the load on the fold enhancing roller rotating shaft 411 when the fold enhancing processing unit 4 according to the embodiment is in the fold enhancing processing operation. In FIG. 24, a solid line graph represents the sum total of the load on the fold enhancing roller rotating shaft 411 in the configuration of the fold enhancing roller 410 illustrated in FIGS. 17 to 19.

Dashed line graphs in FIG. 24 represent the load on the fold enhancing roller rotating shaft 411 assuming that each set of the pressing force transmitting parts 412 configuring the fold enhancing roller 410 illustrated in FIGS. 17 to 19 independently presses the sheet 6. The dashed line graphs in FIG. 24 are about the first set, the second set, the third set, . . . , and the fifteenth set of the pressing force transmitting parts 412 in the fold enhancing roller 410 illustrated in FIGS. 17 to 19 sequentially in the order from the left of when facing FIG. 24.

In the fold enhancing roller 410 illustrated in FIGS. 17 to 19, the first set of the pressing force transmitting part 412 includes only one pressing force transmitting part 412 unlike the second to the fifteenth sets thereof each including two pressing force transmitting parts 412. Accordingly, the load on the fold enhancing roller rotating shaft 411 when the first set of the pressing force transmitting part 412 is assumed to independently press the sheet 6 is half of the load when the other set of the pressing force transmitting parts 412 is assumed to independently press the sheet 6.

An alternate long and short dash line graph in FIG. 24 represents the load on the fold enhancing roller rotating shaft when the conventional fold enhancing processing unit is in the fold enhancing processing operation.

As represented with a dashed line in FIG. 24, the load on the fold enhancing roller rotating shafts 411 exerted by each set when each set of the pressing force transmitting parts 412 configuring the fold enhancing roller 410 illustrated in FIGS. 17 to 19 is assumed to independently press the sheet 6 is smaller than the load on the fold enhancing roller rotating shaft in the conventional fold enhancing processing unit.

As represented with the dashed line in FIG. 24, the sum total of the load on the fold enhancing roller rotating shaft 411 in the configuration of the fold enhancing roller 410 illustrated in FIGS. 17 to 19 is also smaller than that of the fold enhancing roller rotating shaft in the conventional fold enhancing processing unit. This is because, as illustrated in FIGS. 11 to 13, FIGS. 14 to 16, and FIGS. 17 to 19, respective sets of the pressing force transmitting parts 412 configuring the fold enhancing roller 410 according to the embodiment are configured to sequentially press the sheet 6 at different timings in the main-scanning direction.

Accordingly, the fold enhancing processing unit 4 according to the embodiment can achieve a fold enhancing effect equivalent to or larger than that of the fold enhancing roller in the conventional fold enhancing processing unit with a pressing force smaller than that of the fold enhancing roller in the conventional fold enhancing processing unit, and can reduce the load on the fold enhancing roller rotating shaft 411. That is, the fold enhancing processing unit 4 according to the embodiment can apply a sufficient pressing force to the fold while reducing the load on the fold enhancing roller rotating shaft 411.

Figure 25:
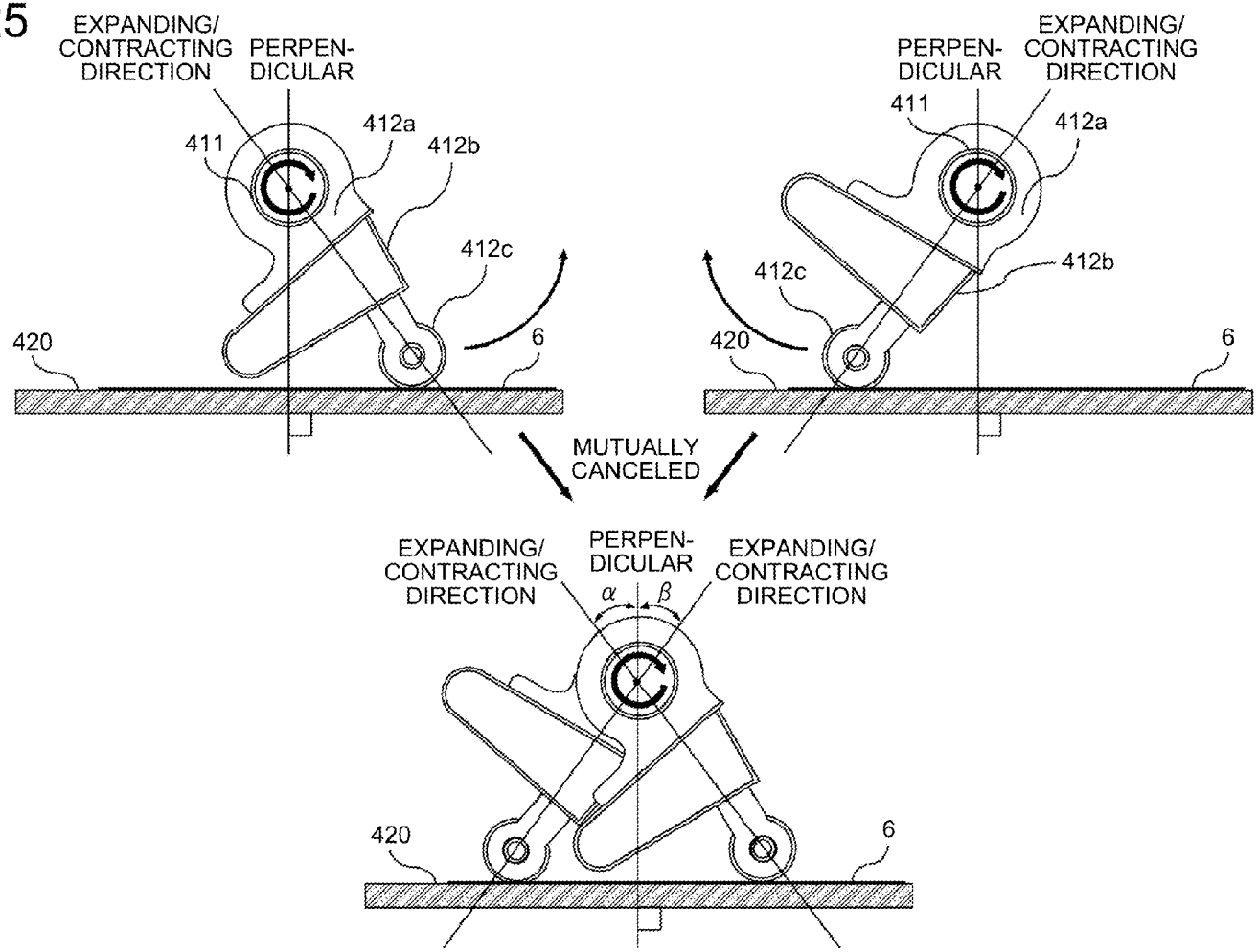
FIG. 25 is a diagram for explaining a moment of rotation applied to the fold enhancing roller rotating shaft when the fold enhancing processing unit according to the embodiment of the present invention is in the fold enhancing processing operation.

Subsequently, the following describes load torque on the fold enhancing roller driving motor 471 when the fold enhancing processing unit 4 according to the embodiment is in the fold enhancing processing operation with reference to FIG. 25. FIG. 25 is a diagram for explaining a moment of rotation applied to the fold enhancing roller rotating shaft 411 when the fold enhancing processing unit 4 according to the embodiment is in the fold enhancing processing operation.

As illustrated in FIG. 25, when the fold enhancing processing unit 4 according to the embodiment is in the fold enhancing processing operation, the moment of rotation is generated in a direction opposite to the rotational direction of the fold enhancing roller 410 from the time when the pressing roller 412*c* of the pressing force transmitting part 412 starts to abut on the sheet 6 until the expanding/contracting direction of the elastic body 412*b* becomes parallel to a perpendicular extending from the fold enhancing roller rotating shaft 411 to the sheet supporting plate 420. On the other hand, as illustrated in FIG. 25, when the fold enhancing processing unit 4 according to the embodiment is in the fold enhancing processing operation, the moment of rotation is generated in the same direction as the rotational direction of the fold enhancing roller 410 from the time when the expanding/contracting direction of the elastic body 412*b* becomes parallel to the perpendicular until the pressing roller 412*c* of the pressing force transmitting part 412 is separated from the sheet 6.

Accordingly, when each set of the pressing force transmitting parts 412 configuring the fold enhancing roller 410 according to the embodiment is assumed to independently press the sheet 6, the moment of rotation thereof becomes the load torque on the fold enhancing roller driving motor 471.

However, the fold enhancing roller 410 according to the embodiment is configured as illustrated in FIGS. 11 to 13, FIGS. 14 to 16, and FIGS. 17 to 19, so that the moment of rotation caused by a certain set of the pressing force transmitting parts 412 is generated in the direction opposite to the moment of rotation caused by the other set of the pressing force transmitting parts 412 as illustrated in FIG. 25. Accordingly, the moments of rotation are mutually canceled, and the sum total of the moment of rotation is reduced. Due to this processing, the image forming apparatus 1 according to the embodiment can reduce the load torque on the fold enhancing roller driving motor 471 in the fold enhancing processing operation. Accordingly, the fold enhancing processing unit 4 according to the embodiment can apply a sufficient pressing force to the fold while reducing the load on the fold enhancing roller rotating shaft 411.

Specifically, as illustrated in FIG. 25, assuming that an angle between the perpendicular and the expanding/contracting direction of the elastic body 412*b* configuring a certain set of the pressing force transmitting parts 412 is $\alpha$ and an angle between the perpendicular and the expanding/contracting direction of the elastic body 412*b* configuring the other set of the pressing force transmitting parts 412 is $\beta$, $\alpha$ is equal to $\beta$, the moment of rotation caused by the certain set of the pressing force transmitting parts 412 and the moment of rotation caused by the other set of the pressing force transmitting parts 412 are completely canceled by each other, and the sum total thereof becomes 0.

The force to be canceled is only a force in the rotational direction about the fold enhancing roller rotating shaft 411. A force in a vertically downward direction from the fold enhancing roller rotating shaft 411, that is, a pressing force on the sheet supporting plate 420 caused by the elastic force of the elastic body 412*b* is not affected. Accordingly, the fold enhancing processing unit 4 according to the embodiment can apply a sufficient pressing force to the fold while reducing the load on the fold enhancing roller rotating shaft 411.

Figure 26:
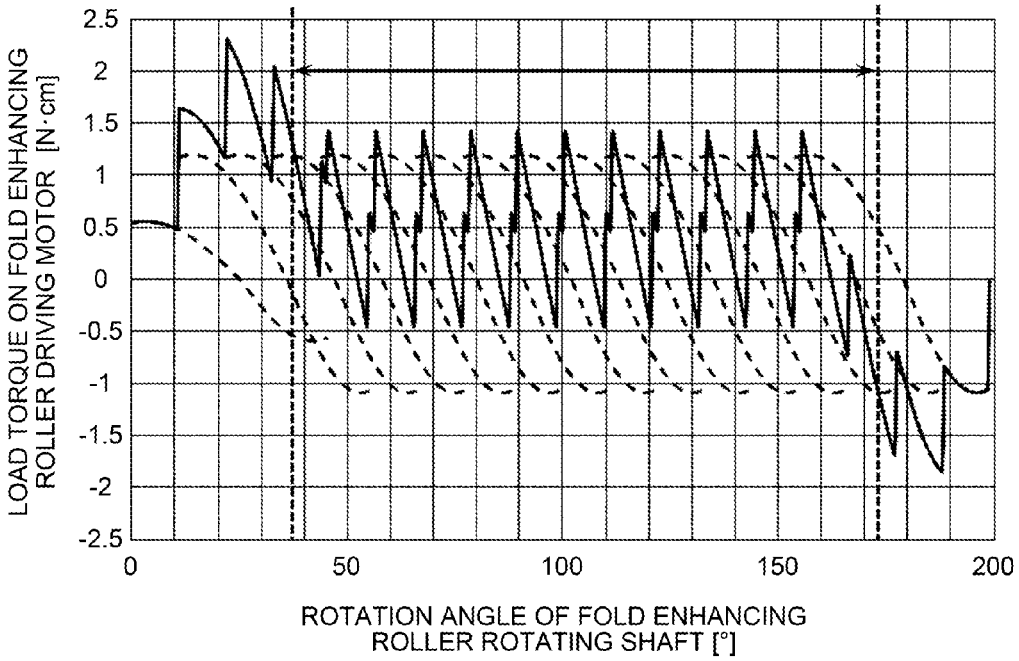
FIG. 26 is a graph illustrating load torque on a fold enhancing roller driving motor when the fold enhancing processing unit according to the embodiment of the present invention is in the fold enhancing processing operation.

FIG. 26 illustrates a state of change in the load torque on the fold enhancing roller driving motor 471 when the fold enhancing processing unit 4 according to the embodiment is in the fold enhancing processing operation. FIG. 26 is a graph illustrating the load torque on the fold enhancing roller driving motor 471 when the fold enhancing processing unit 4 according to the embodiment is in the fold enhancing processing operation. In FIG. 26, a solid line graph represents the sum total of the load torque on the fold enhancing roller driving motor 471 when the fold enhancing roller rotating shaft 411 is rotated in the configuration of the fold enhancing roller 410 illustrated in FIGS. 17 to 19.

Dotted line graphs in FIG. 26 represent the load torque on the fold enhancing roller driving motor 471 assuming that each set of the pressing force transmitting parts 412 configuring the fold enhancing roller 410 illustrated in FIGS. 17 to 19 independently presses the sheet 6. The dotted line graphs in FIG. 26 is about the first set, the second set, the third set, . . . , and the fifteenth set of the pressing force transmitting parts 412 in the fold enhancing roller 410 illustrated in FIGS. 17 to 19 sequentially in the order from the left of when facing FIG. 26.

In the fold enhancing roller 410 illustrated in FIGS. 17 to 19, the first set of the pressing force transmitting part 412 includes only one pressing force transmitting part 412 unlike the second to the fifteenth sets thereof each including two pressing force transmitting parts 412. Accordingly, the load torque on the fold enhancing roller driving motor 471 when the first set of the pressing force transmitting part 412 is assumed to independently press the sheet 6 is half of the load torque when the other set of the pressing force transmitting parts 412 is assumed to independently press the sheet 6.

As illustrated in FIG. 26, when the rotation angle of the fold enhancing roller rotating shaft 411 is around 38° to 173°, an absolute value of the load torque on the fold enhancing roller driving motor 471 when the fold enhancing processing unit 4 according to the embodiment is in the fold enhancing processing operation is smaller than that in a case in which each set of the pressing force transmitting parts 412 is assumed to independently press the sheet 6. This is because, as described above, the moment of rotation caused by a certain set of the pressing force transmitting parts 412 and the moment of rotation caused by the other set of the pressing force transmitting parts 412 are mutually canceled. Accordingly, the fold enhancing processing unit 4 according to the embodiment can apply a sufficient pressing force to the fold while reducing the load on the fold enhancing roller rotating shaft 411.

Figure 27:
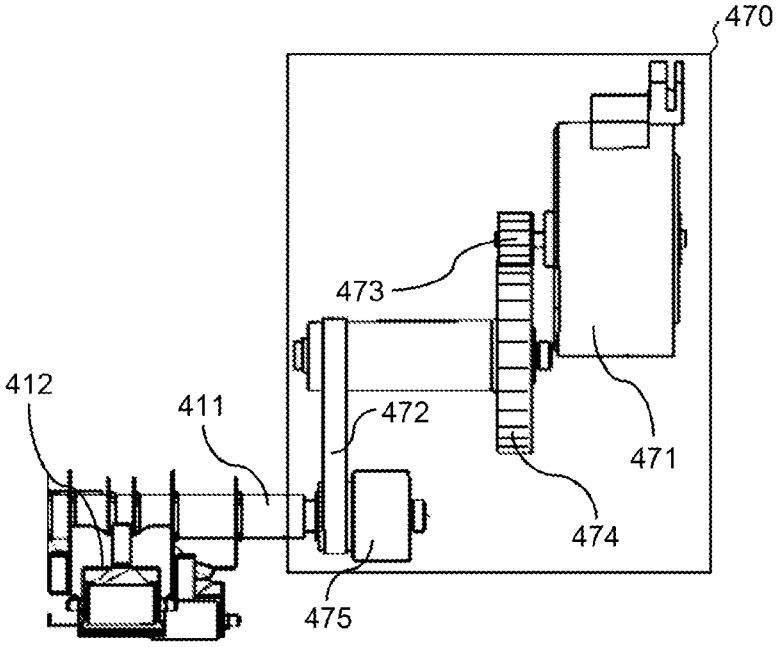
FIG. 27 is a diagram of a fold enhancing roller driving device according to the embodiment of the present invention viewed from the main-scanning direction.
Figure 28:
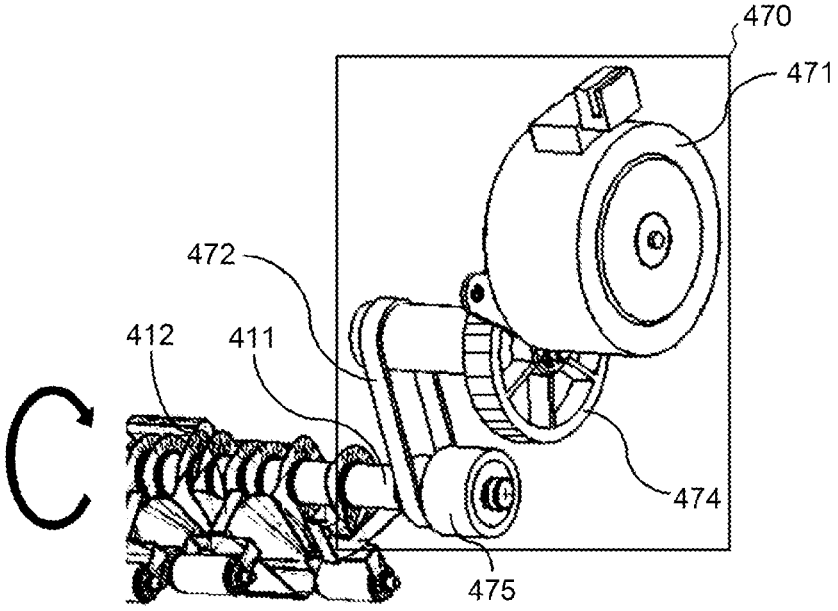
FIG. 28 is a perspective view of the fold enhancing roller driving device according to the embodiment of the present invention.

Subsequently, the following describes a structure of the fold enhancing roller driving device 470 according to the embodiment with reference to FIG. 27 and FIG. 28. FIG. 27 is a diagram of the fold enhancing roller driving device 470 according to the embodiment viewed from the main-scanning direction. FIG. 28 is a perspective view of the fold enhancing roller driving device 470 according to the embodiment.

As illustrated in FIG. 27 and FIG. 28, the fold enhancing roller driving device 470 according to the embodiment is arranged at one end in the main-scanning direction of the fold enhancing roller 410, and includes the fold enhancing roller driving motor 471, the timing belt 472, a reverse gear 473, an fold enhancing roller rotating gear pulley 474, and a fold enhancing roller rotating pulley 475.

The fold enhancing roller driving motor 471 is a motor for rotating the reverse gear 473. The fold enhancing roller rotating gear pulley 474 is a pulley including a gear meshed with the reverse gear 473, and rotates in a direction opposite to the rotational direction of the reverse gear 473 when the reverse gear 473 rotates. The timing belt 472 is an endless belt for transmitting the rotation of the fold enhancing roller rotating gear pulley 474 to the fold enhancing roller rotating pulley 475. The fold enhancing roller rotating pulley 475 is coupled to the fold enhancing roller rotating shaft 411, and is rotated in the same direction as the fold enhancing roller rotating gear pulley 474 by the timing belt 472 when the fold enhancing roller rotating gear pulley 474 rotates. Accordingly, the fold enhancing roller rotating shaft 411 is rotated in the rotational direction thereof.

To rotate the fold enhancing roller 410 in the arrow direction illustrated in FIG. 28, the fold enhancing roller driving device 470 configured as described above first rotates the fold enhancing roller driving motor 471 in a direction opposite to the arrow illustrated in FIG. 28 according to control by the engine control part 102 to rotate the reverse gear 473 in the direction opposite to the arrow direction illustrated in FIG. 28. Due to this processing, the fold enhancing roller rotating gear pulley 474 rotates in the same direction as the arrow illustrated in FIG. 28, and transmits the rotation to the fold enhancing roller rotating pulley 475 via the timing belt 472.

When the fold enhancing roller rotating pulley 475 rotates, the fold enhancing roller rotating shaft 411 is rotated by interlocking therewith, so that the fold enhancing roller 410 is rotated in the arrow direction illustrated in FIG. 28. When the fold enhancing roller driving device 470 rotates the fold enhancing roller 410 in the direction opposite to the arrow illustrated in FIG. 28, each component is reversely rotated.

As described above, one of the main points of the configuration of the fold enhancing processing unit 4 according to the embodiment is that, in pressing the sheet 6 for enhancing the first fold 6*a* and the second fold 6*b* formed on the sheet 6, the sheet 6 is pressed from the surface on which the first fold 6*a* and the second fold 6*b* are formed as illustrated in FIGS. 21A to 21E and FIGS. 23A to 23E in fold enhancing processing. Due to such a configuration, the fold enhancing processing unit 4 according to the embodiment can prevent a folding wrinkle, a pressed mark, and the like from being formed on the sheet 6 after fold enhancing processing. Accordingly, the fold enhancing processing unit 4 according to the embodiment can improve the quality of the sheet 6 after enhancing the fold thereof.

As described above with reference to FIGS. 21A to 21E and FIGS. 23A to 23E, the embodiment describes an example of pressing the sheet 6 that is folded such that the fold is positioned between the front end and the rear end in the conveying direction. In addition, for example, as illustrated in FIG. 7C, the same effect as that in the embodiment can be obtained in a case of pressing the sheet 6 that is folded such that the fold is positioned at the front end or the rear end in the conveying direction. A reason for that will be described with reference to FIGS. 29A and 29B, and FIGS. 30A and 30B. FIGS. 29A and 29B and FIGS. 30A and 30B are diagrams illustrating a state in which the conventional fold enhancing processing unit presses the sheet 6 that is folded such that the first fold 6*a* is positioned at the front end in the conveying direction, from the surface opposite to the surface on which the first fold 6*a* is formed.

Figure 29A:
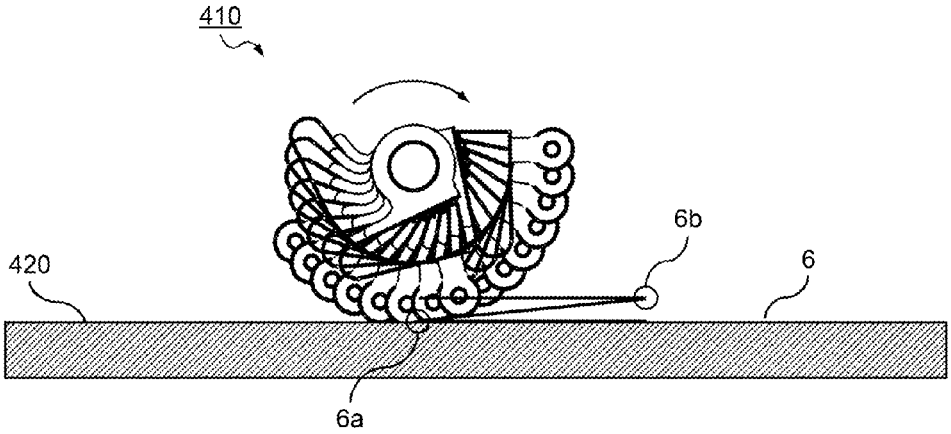
FIGS. 29A and 29B are diagrams illustrating a state in which the conventional fold enhancing processing unit presses the sheet folded such that the fold is positioned at the front end in the conveying direction, from the surface opposite to the surface on which the fold is formed.
Figure 29B:
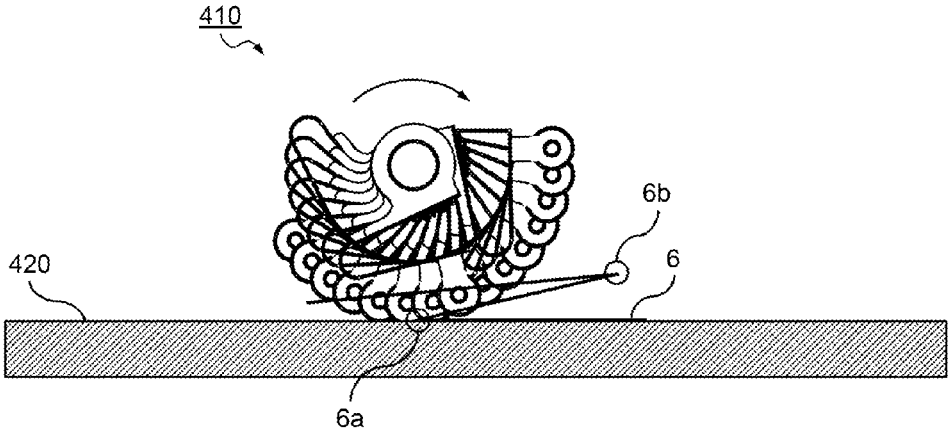
Figure 30A:
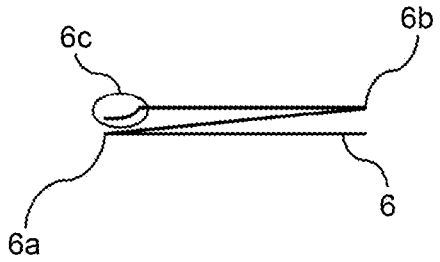
FIGS. 30A and 30B are diagrams illustrating a state in which the conventional fold enhancing processing unit according to the embodiment of the present invention presses the sheet folded such that the fold is positioned at the front end in the conveying direction, from the surface opposite to the surface on which the fold is formed.
Figure 30B:
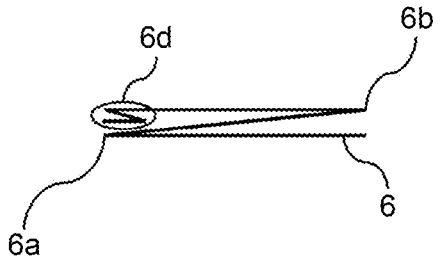

As illustrated in FIG. 29A, when the conventional fold enhancing processing unit presses the sheet 6 that is folded such that the first fold 6*a* is positioned at the front end in the conveying direction, from the surface opposite to the surface on which the first fold 6*a* is formed, a portion overlapped with the first fold 6*a* is moved following the rotation of the fold enhancing roller 410 due to friction between the pressing roller 412*c* and the sheet 6 as illustrated in FIG. 29B and enters a state similar to that illustrated in FIG. 22A. As a result, when the conventional fold enhancing processing unit presses the sheet 6 that is folded such that the first fold 6*a* is positioned at the front end in the conveying direction, from the surface opposite to the surface on which the first fold 6*a* is formed, the pressed mark 6*c* or the folding wrinkle 6*d* is formed on the sheet 6 as illustrated in FIGS. 30A and 30B.

In this way, even in a case of pressing the sheet 6 that is folded such that the fold is positioned at the front end or the rear end in the conveying direction, the pressed mark 6*c* or the folding wrinkle 6*d* is formed on the sheet 6 similarly to the case of pressing the sheet 6 that is folded such that the fold is positioned between the front end and the rear end in the conveying direction. Accordingly, in the embodiment, the same effect as that in the embodiment can be obtained in the case of pressing the sheet 6 that is folded such that the fold is positioned at the front end or the rear end in the conveying direction in addition to the case of pressing the sheet 6 that is folded such that the fold is positioned between the front end and the rear end in the conveying direction.

The embodiment describes an example in which the fold enhancing processing unit 4 rotates the fold enhancing roller 410 once in one direction to press one fold once from a specific direction. Alternatively, the fold enhancing processing unit 4 may be configured to rotate the fold enhancing roller 410 multiple times in one direction to press one fold multiple times from a specific direction, or to rotate the fold enhancing roller 410 in both directions to press one fold multiple times from both of the sheet conveying direction and the opposite direction thereof. Due to such a configuration, the fold enhancing processing unit 4 according to the embodiment can obtain a greater fold enhancing effect.

The structure of the fold enhancing roller 410 according to the embodiment is not limited to that illustrated in FIGS.

8 to 10, FIGS. 11 to 13, FIGS. 14 to 16, and FIGS. 17 to 19. The same effect can be obtained when the fold enhancing roller 410 is configured such that the pressing force transmitting parts 412 are arranged around the fold enhancing roller rotating shaft 411 in the main-scanning direction such that each of the pressing force transmitting parts 412 receives a stress from the sheet supporting plate 420 to cause the elastic body 412*b* to be expanded and contracted at least at a timing different from any other pressing force transmitting part 412 according to a positional relation with respect to the sheet supporting plate 420 that is changed with the rotation of the fold enhancing roller rotating shaft 411.

Figure 31:
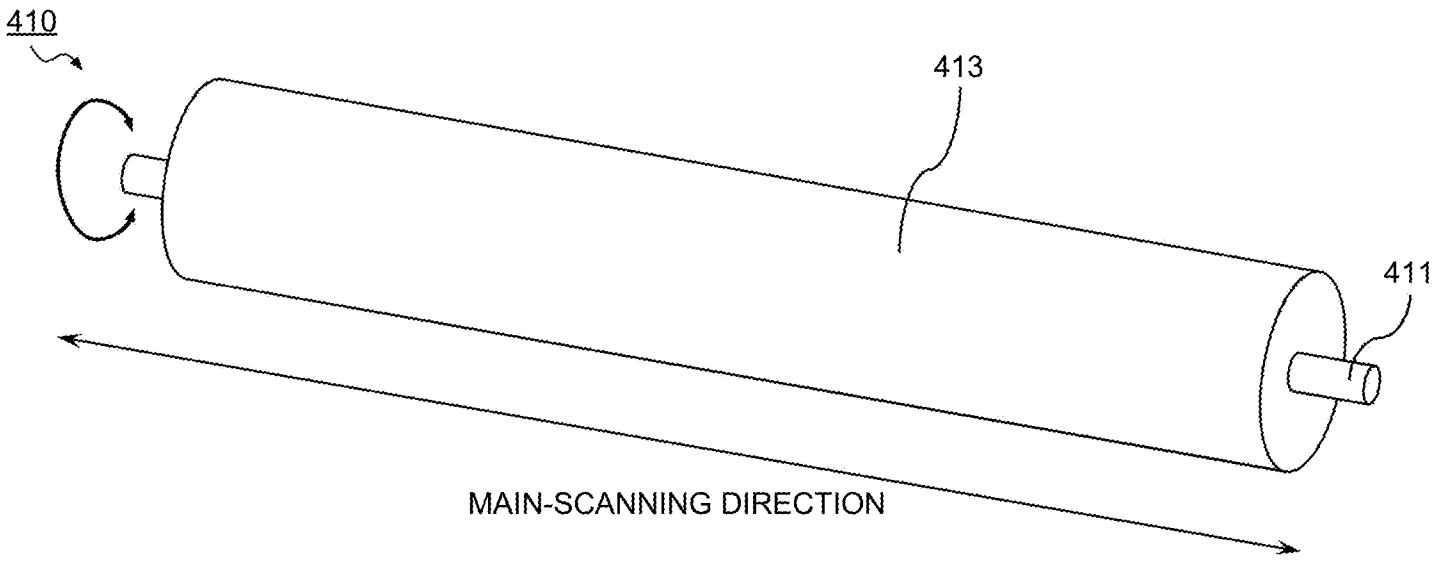
FIG. 31 is a perspective view of the fold enhancing roller according to the embodiment of the present invention viewed from above obliquely to the main-scanning direction.

Alternatively, as illustrated in FIG. 31, the fold enhancing roller 410 according to the embodiment may be configured such that a pressing force transmitting roller 413 is attached to the fold enhancing roller rotating shaft 411. FIG. 31 is a perspective view of the fold enhancing roller 410 according to the embodiment viewed from above obliquely to the main-scanning direction. In FIG. 31, the pressing force transmitting roller 413 is a roller for transmitting the pressing force to the fold formed on the sheet 6 by pressing the sheet 6 against the sheet supporting plate 420.

The embodiment describes the configuration in which the image forming apparatus 1 includes the image forming unit 2, the folding processing unit 3, the fold enhancing processing unit 4, and the scanner unit 5. Alternatively, each of the units may be configured as an independent device, and the devices may be coupled to each other to configure the image forming system.

Figure 32:
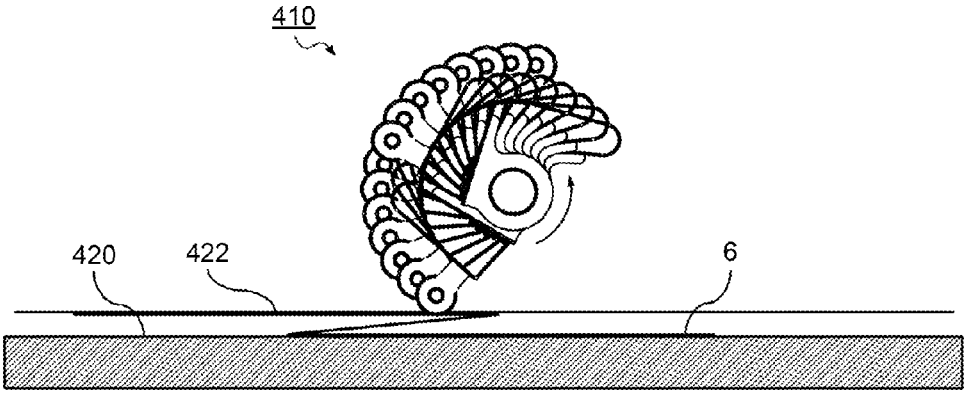
FIG. 32 is a cross-sectional view of a fold enhancing processing device according to the embodiment of the present invention viewed from the main-scanning direction.
Figure 33:
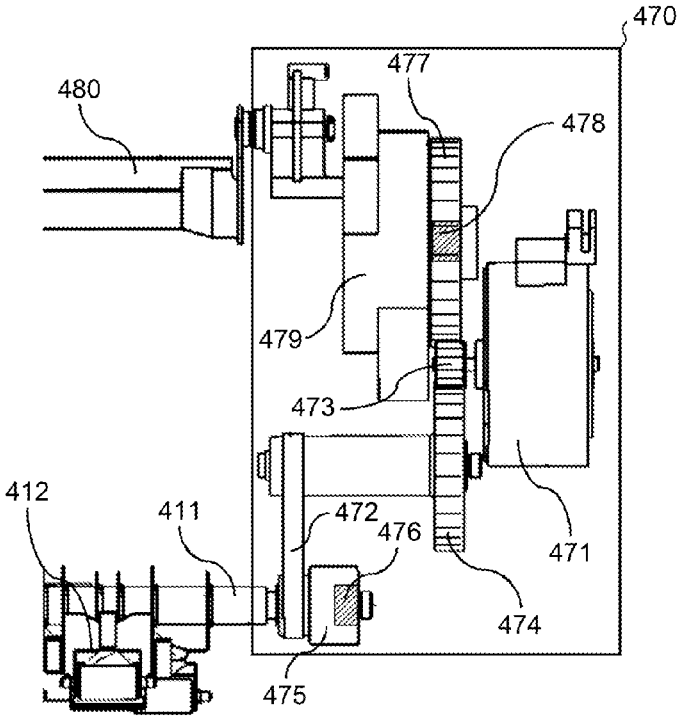
FIG. 33 is a diagram of the fold enhancing roller driving device according to the embodiment of the present invention viewed from the main-scanning direction.

As illustrated in FIG. 32, the fold enhancing processing unit 4 according to the embodiment may be configured to include a shock buffering sheet 422 between the sheet 6 and the fold enhancing roller 410. FIG. 33 is a cross-sectional view of the fold enhancing processing unit 4 according to the embodiment viewed from the main-scanning direction. In this way, the fold enhancing processing unit 4 according to the embodiment includes the shock buffering sheet 422 between the sheet 6 and the fold enhancing roller 410, so that the fold enhancing roller 410 abuts only on the shock buffering sheet 422 and is not brought in directly contact with the sheet 6. Due to this structure, the fold enhancing processing unit 4 according to the embodiment can more efficiently prevent a folding wrinkle, a pressed mark, and the like from being formed on the sheet 6 after fold enhancing processing. Accordingly, the fold enhancing processing unit 4 according to the embodiment can further improve the quality of the sheet 6 after enhancing the fold thereof.

In this way, the fold enhancing processing unit 4 according to the embodiment includes the shock buffering sheet 422 between the sheet 6 and the fold enhancing roller 410, so that the shock buffering sheet 422 buffers a shock between the fold enhancing roller 410 and the sheet supporting plate 420 and absorbs collision sound at that time. Due to this structure, the collision sound can be suppressed. The shock buffering sheet 422 is configured with a buffer such as rubber, a sponge, and plastic resin similarly to a shock buffer 421. That is, in the embodiment, the shock buffer 421 and the shock buffering sheet 422 function as a shock buffer.

The embodiment describes an example in which the fold enhancing roller 410 and the sheet supporting plate 420 are arranged as illustrated in FIG. 4A to FIG. 6C. Alternatively, the fold enhancing roller 410 and the sheet supporting plate 420 may be arranged upside down with respect to the arrangement illustrated in FIG. 4A to FIG. 6C as long as they are arranged so as to press the sheet 6 from the surface on which the fold is formed.

Second Embodiment

As described above with reference to FIG. 27 and FIG. 28, the first embodiment describes a configuration in which the fold enhancing roller 410 can rotate in both of a clockwise direction and a counterclockwise direction using the fold enhancing roller rotating shaft 411 as a rotation axis. In this case, as described above with reference to FIGS. 21A to 21E and FIGS. 23A to 23E, the fold enhancing processing unit 4 can press the fold formed on the sheet 6 from both directions in the sub-scanning direction.

On the other hand, the embodiment describes a configuration in which the fold enhancing roller 410 can rotate in only one of the clockwise direction or the counterclockwise direction using the fold enhancing roller rotating shaft 411 as a rotation axis. In this case, although the fold enhancing processing unit 4 can press the fold formed on the sheet from only one direction in the sub-scanning direction, it is possible to utilize the driving force of the fold enhancing roller driving motor 471 for rotating the fold enhancing roller 410 in a direction opposite to the rotatable direction for another driving system. Details will be described below. Components denoted by the same reference numerals as those in the first embodiment represent the same or corresponding components, so that detailed description thereof will not be repeated.

Figure 34:
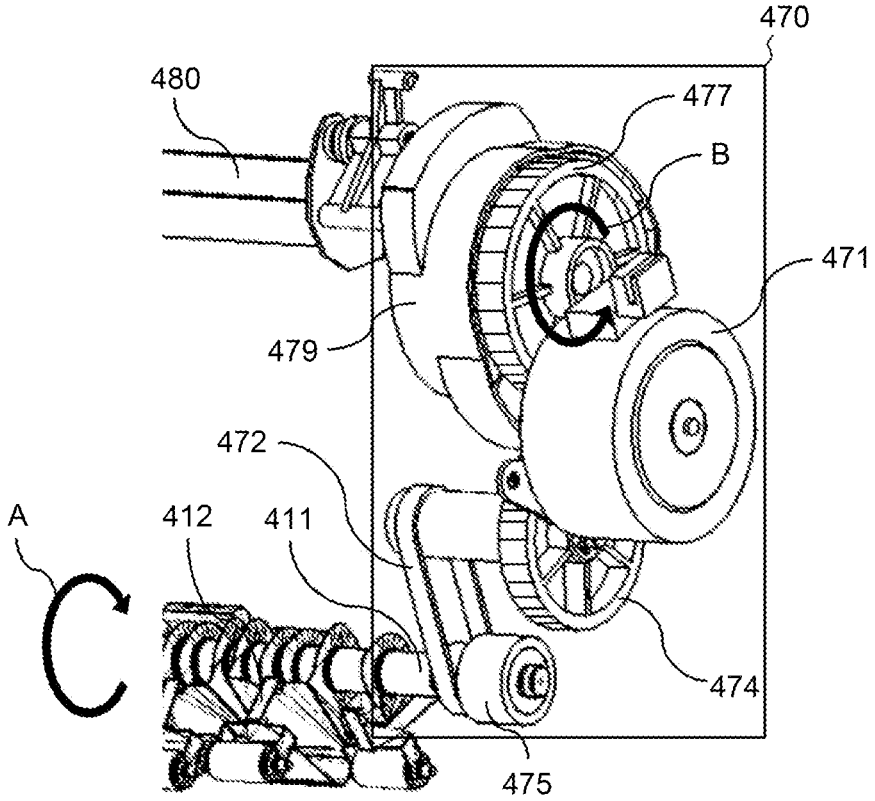
FIG. 34 is a perspective view of the fold enhancing roller driving device according to the embodiment of the present invention.

First, the following describes a structure of the fold enhancing roller driving device 470 according to the embodiment with reference to FIG. 33 and FIG. 34. FIG. 33 is a diagram of the fold enhancing roller driving device 470 according to the embodiment viewed from the main-scanning direction. FIG. 34 is a perspective view of the fold enhancing roller driving device 470 according to the embodiment.

As illustrated in FIG. 33 and FIG. 34, the fold enhancing roller driving device 470 according to the embodiment includes a one-way clutch 476, a reverse rotation gear 477, a one-way clutch 478, and a reverse rotation cam 479 in addition to the structures illustrated in FIG. 27 and FIG. 28.

The one-way clutch 476 is arranged inside the fold enhancing roller rotating pulley 475 and configured as follows. Only when the fold enhancing roller rotating pulley 475 rotates in a specific direction, the one-way clutch 476 rotates the fold enhancing roller rotating shaft 411 in the same direction. When the fold enhancing roller rotating pulley 475 rotates in a direction opposite to the specific direction, the one-way clutch 476 slips and does not rotate the fold enhancing roller rotating shaft 411. That is, in the embodiment, the one-way clutch 476 functions as a driving force blocking part.

The one-way clutch 476 according to the embodiment is configured as follows. Only when the fold enhancing roller rotating pulley 475 rotates in the arrow A direction illustrated in FIG. 34, the one-way clutch 476 rotates the fold enhancing roller rotating shaft 411 in the same direction. When the fold enhancing roller rotating pulley 475 rotates in a direction opposite to the arrow A direction illustrated in FIG. 34, the one-way clutch 476 slips.

The reverse rotation gear 477 is a gear meshed with the reverse gear 473, and rotates in a direction opposite to the rotational direction of the reverse gear 473, that is, in the same direction as the fold enhancing roller rotating gear pulley 474 when the reverse gear 473 rotates. The one-way clutch 478 is arranged inside the reverse rotation gear 477 and configured as follows. Similarly to the one-way clutch 476, only when the reverse rotation gear 477 rotates in a specific direction, the one-way clutch 478 rotates the reverse rotation cam 479 in the same direction. When the reverse rotation gear 477 rotates in a direction opposite to the specific direction, the one-way clutch 478 slips and does not rotate the reverse rotation cam 479.

The one-way clutch 478 according to the embodiment is configured as follows. Only when the reverse rotation gear 477 rotates in the arrow B direction illustrated in FIG. 34, the one-way clutch 478 rotates the reverse rotation cam 479 in the same direction. When the reverse rotation gear 477 rotates in a direction opposite to the arrow B direction illustrated in FIG. 34, the one-way clutch 478 slips.

The one-way clutch 476 and the one-way clutch 478 are configured as described above, so that even when the fold enhancing roller driving motor 471 rotates, only one of the fold enhancing roller rotating pulley 475 and the reverse rotation cam 479 is rotated. The rotational directions of the fold enhancing roller rotating pulley 475 and the reverse rotation cam 479 are opposite to each other.

The reverse rotation cam 479 includes a curved surface a distance from which to the rotation axis of the reverse rotation gear 477 is not constant. A portion of the curved surface the distance from which to the rotation axis of the reverse rotation gear 477 is long is coupled to a reverse rotation drive transmitting part 480 for transmitting rotational motion of the reverse rotation cam 479 to a driving system other than the fold enhancing roller 410.

To rotate the fold enhancing roller 410 in the arrow A direction illustrated in FIG. 34, the fold enhancing roller driving device 470 configured as described above first rotates the fold enhancing roller driving motor 471 in a direction opposite to the arrow A illustrated in FIG. 34 according to control by the engine control part 102 to rotate the reverse gear 473 in the direction opposite to the arrow A direction illustrated in FIG. 34. Accordingly, the fold enhancing roller rotating gear pulley 474 is rotated in the same direction as the arrow A illustrated in FIG. 34, and transmits the rotation to the fold enhancing roller rotating pulley 475 via the timing belt 472.

When the fold enhancing roller rotating pulley 475 rotates, the fold enhancing roller rotating shaft 411 is rotated by interlocking therewith, and the fold enhancing roller 410 is rotated in the direction illustrated in FIG. 28. In this case, the reverse rotation gear 477 does not rotate due to a function of the one-way clutch 478.

On the other hand, when the fold enhancing roller driving device 470 configured as described above utilizes the driving force of the fold enhancing roller driving motor 471 for another driving system, the fold enhancing roller driving device 470 first rotates the fold enhancing roller driving motor 471 in a direction opposite to the arrow B illustrated in FIG. 34 according to control by the engine control part 102 to rotate the reverse rotation gear 477 in a direction opposite to the arrow B direction illustrated in FIG. 34.

Accordingly, the reverse rotation cam 479 is rotated in the same direction as the arrow B illustrated in FIG. 34, and transmits the rotational motion thereof to a driving system other than the fold enhancing roller 410 via the reverse rotation drive transmitting part 480. In this case, the fold enhancing roller rotating pulley 475 does not rotate due to a function of the one-way clutch 476. That is, in the embodiment, the reverse rotation drive transmitting part 480 functions as a drive transmitting part for another driving unit.

Due to such a configuration, the fold enhancing processing unit 4 according to the embodiment can utilize the driving force of the fold enhancing roller driving motor 471 for rotating the fold enhancing roller 410 in a direction opposite to the rotatable direction for another driving system.

Figure 35A:
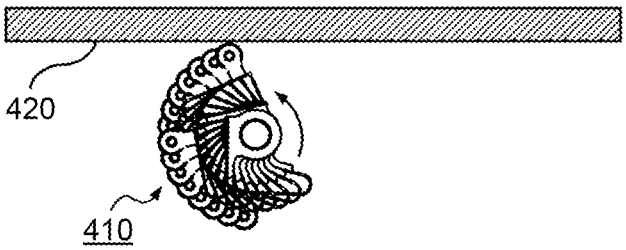
FIGS. 35A and 35B are cross-sectional views only of a mechanism related to fold enhancing processing in the fold enhancing processing unit viewed from the main-scanning direction when the fold enhancing processing unit according to the embodiment of the present invention ends fold enhancing processing.
Figure 35B:
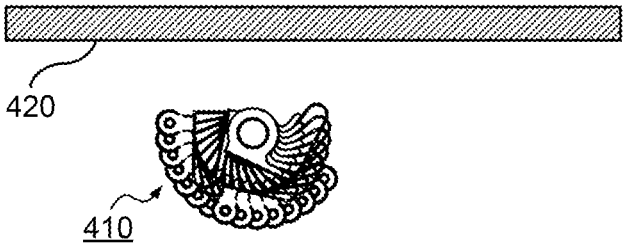

When the fold enhancing roller driving device 470 is configured as described above, as illustrated in FIG. 4A to FIG. 6C, the fold enhancing roller 410 and the sheet supporting plate 420 are preferably arranged such that the fold enhancing roller 410 is located lower and the sheet supporting plate 420 is located higher with respect to the gravity direction. This is because the fold enhancing roller 410 can return to an appropriate standby position under its own weight as illustrated in FIGS. 35A and 35B after pressing the sheet 6. FIGS. 35A and 35B are cross-sectional views only of a mechanism related to fold enhancing processing in the fold enhancing processing unit 4 viewed from the main-scanning direction when the fold enhancing processing unit 4 according to the embodiment ends the fold enhancing processing.

Figure 36:
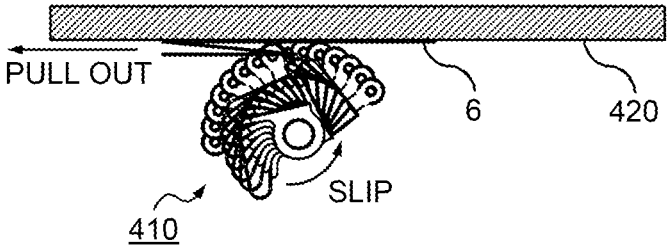
FIG. 36 is a cross-sectional view only of a mechanism related to fold enhancing processing in the fold enhancing processing unit viewed from the main-scanning direction when the fold enhancing processing unit according to the embodiment of the present invention is stopped during execution of the fold enhancing processing and the sheet is pulled out.

When the fold enhancing roller driving device 470 is configured as described above, as illustrated in FIG. 36, even if the sheet 6 is pulled out from the downstream in the sheet conveying direction when the fold enhancing roller 410 is stopped in a state of pressing the sheet 6, the fold enhancing roller 410 slips in that direction. Accordingly, it is possible to prevent the sheet 6 from being torn or prevent each mechanism from being damaged. FIG. 36 is a cross-sectional view only of a mechanism related to fold enhancing processing in the fold enhancing processing unit 4 viewed from the main-scanning direction when the fold enhancing processing unit 4 according to the embodiment is stopped during execution of the fold enhancing processing and the sheet 6 is pulled out.

When the fold enhancing roller driving device 470 is configured as described above, the fold enhancing processing unit 4 first stops the rotation of the fold enhancing roller driving motor 471 to stop the rotation of the fold enhancing roller 410. However, the fold enhancing roller 410 continues to rotate in the same direction for a while by a moment of rotation caused by its own inertial force due to the function of the one-way clutch 476. This is because, even when the rotation of the fold enhancing roller driving motor 471 is stopped, the moment of rotation caused by the inertial force cannot be canceled from a direction opposite to the rotational direction of the fold enhancing roller 410 due to the function of the one-way clutch 476.

Accordingly, in the fold enhancing processing unit 4 according to the embodiment, even when the fold enhancing roller 410 is rotated by a predetermined angle θ and intended to be stopped at the rotation angle θ, the fold enhancing roller 410 actually rotates more than the predetermined angle θ and then stops, so that an accurate rotation angle of the fold enhancing roller 410 cannot be grasped.

Accordingly, when the fold enhancing roller driving device 470 is configured as described above, there is a need for a stopping device for rotating the fold enhancing roller 410 by the predetermined angle θ and accurately stopping it at the rotation angle θ. Due to this need, the fold enhancing processing unit 4 according to the embodiment includes a stopping device 490 for stopping the fold enhancing roller 410 at a predetermined position. That is, in the embodiment, the stopping device 490 functions as a rotation stopping part.

Figure 37:
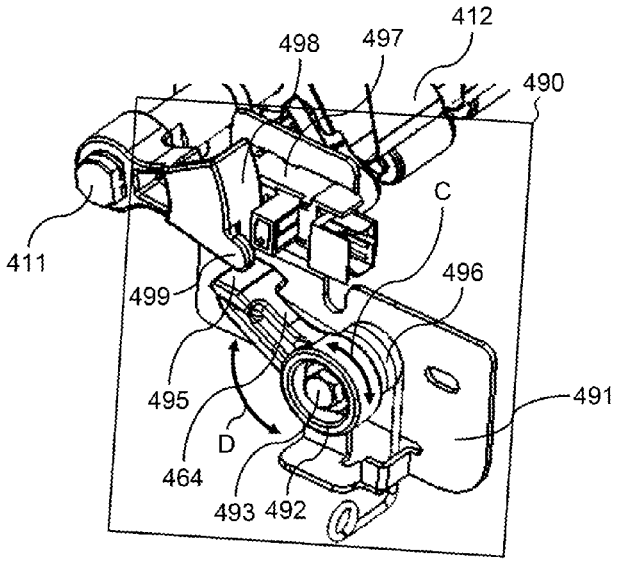
FIG. 37 is a perspective view of a stopping device according to the embodiment of the present invention.
Figure 38:
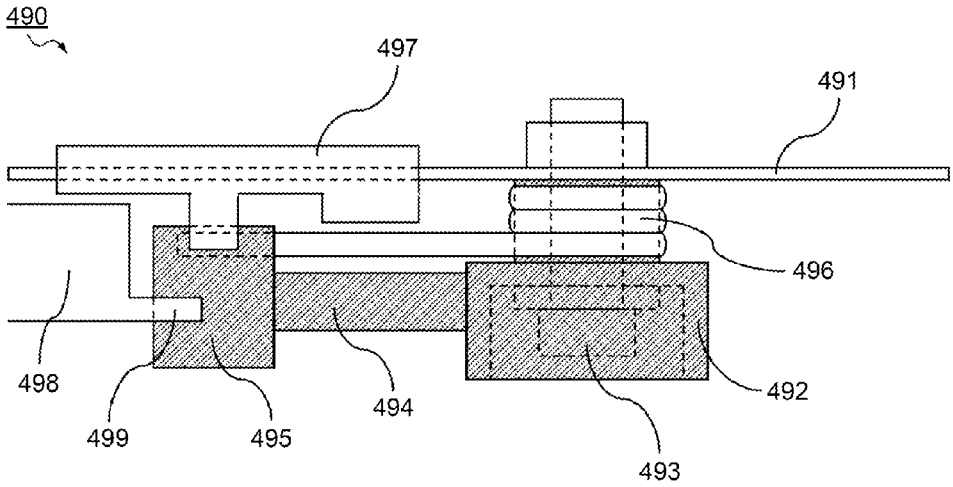
FIG. 38 is a transparent view of the stopping device according to the embodiment of the present invention viewed from a direction perpendicular to a plane formed with the main-scanning direction and the sub-scanning direction.
Figure 39:
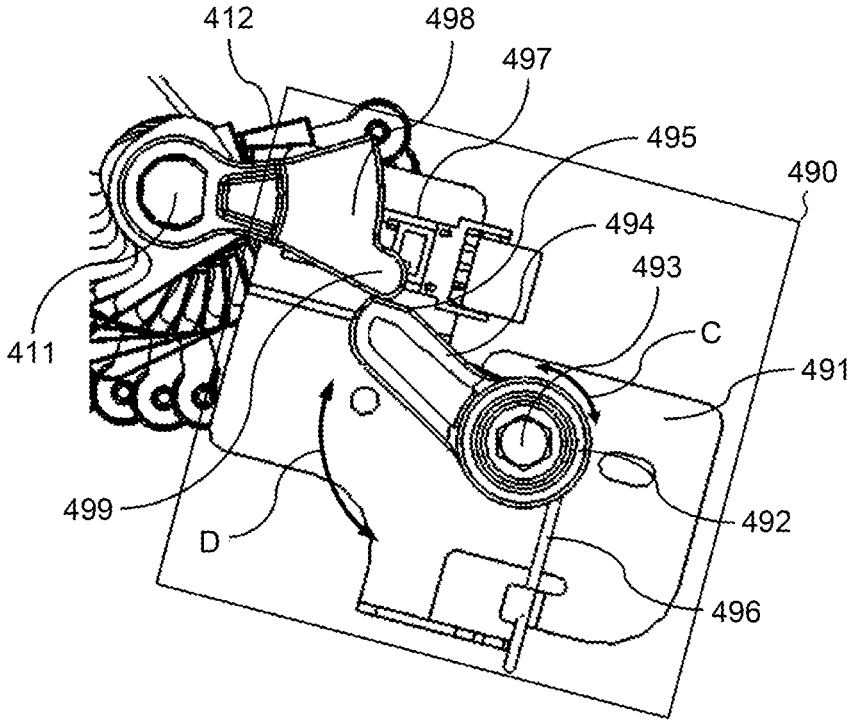
FIG. 39 is a diagram of the stopping device according to the embodiment of the present invention viewed from the main-scanning direction.

The following describes a structure of the stopping device 490 according to the embodiment with reference to FIG. 37 to FIG. 39. FIG. 37 is a perspective view of the stopping device 490 according to the embodiment. FIG. 38 is a transparent view of the stopping device 490 according to the embodiment viewed from a direction perpendicular to a plane formed with the main-scanning direction and the sub-scanning direction. FIG. 39 is a diagram of the stopping device 490 according to the embodiment viewed from the main-scanning direction.

As illustrated in FIG. 37 to FIG. 39, the stopping device 490 according to the embodiment is provided at a side opposite to the fold enhancing roller driving device 470 with respect to the main-scanning direction of the fold enhancing roller 410, and includes a stopping device fixing part 491, a rotation part 492, a rotation screw 493, a coupling part 494, a rotation stopping part 495, a torsion spring 496, a sensor 497, a sensor blocking part 498, and a rotation stopping action part 499.

The stopping device fixing part 491 is a fixing part for fixing the stopping device 490 to the fold enhancing processing unit 4. The rotation part 492 is fixed to the stopping device fixing part 491 with the rotation screw 493 so as to be rotatable in the arrow C direction illustrated in FIG. 37 and FIG. 39 using the rotation screw 493 as a rotation axis. The rotation screw 493 serving as a rotation axis of the rotation part 492 fixes the rotation part 492 to the stopping device fixing part 491 to be rotatable in the arrow C direction illustrated in FIG. 37 and FIG. 39. The coupling part 494 couples the rotation part 492 with the rotation stopping part 495. The rotation stopping part 495 is rotated in the arrow D direction illustrated in FIG. 37 and FIG. 39 using the rotation screw 493 as a rotation axis by being coupled to the rotation part 492 with the coupling part 494.

The torsion spring 496 is a torsion spring attached to the periphery of a portion of the rotation part 492 attached to the stopping device fixing part 491 with the rotation screw 493. One end of the torsion spring 496 is fixed to the stopping device fixing part 491, and the other end thereof is fixed to the rotation stopping part 495. Due to such a configuration, a force is applied to block the rotation of the rotation stopping part 495 using the rotation screw 493 as a rotation axis due to an elastic force of the torsion spring 496, so that the rotation stopping part 495 can be returned to an original position. The elastic force of the torsion spring 496 according to the embodiment is larger than the inertial force of the fold enhancing roller 410.

The sensor 497 includes an infrared ray emitting part that emits infrared rays and an infrared ray receiving part that receives the infrared rays. When the infrared rays emitted from the infrared ray emitting part to the infrared ray receiving part are blocked by the sensor blocking part 498, the sensor 497 notifies the engine control part 102 of that blockage. The sensor blocking part 498 is fixed to the fold enhancing roller rotating shaft 411 to be rotated together with the fold enhancing roller 410. When the fold enhancing roller 410 is rotated by a predetermined angle θ, the sensor blocking part 498 blocks the infrared rays emitted from the infrared ray emitting part to the infrared ray receiving part in the sensor 497. Due to such a configuration, when the sensor blocking part 498 blocks the sensor 497 as described above, the fold enhancing processing unit 4 according to the embodiment is enabled to detect that the fold enhancing roller 410 is rotated by the predetermined angle θ, and at that time, the fold enhancing processing unit 4 is enabled to perform control for stopping the fold enhancing roller 410, that is, control for stopping the rotation of the fold enhancing roller driving motor 471.

The rotation stopping action part 499 is arranged at a distal end of the sensor blocking part 498, and configured to be brought into contact with the rotation stopping part 495 when the fold enhancing roller 410 is rotated by the predetermined angle θ.

By including the stopping device 490 configured as described above, when the fold enhancing processing unit 4 according to the embodiment rotates the fold enhancing roller 410 by the predetermined angle θ and stops the rotation of the fold enhancing roller driving motor 471 to stop the fold enhancing roller 410 at the rotation angle θ, the fold enhancing processing unit 4 can cancel the moment of rotation caused by the inertial force of the fold enhancing roller 410 from the opposite direction.

Accordingly, even if the fold enhancing roller driving device 470 is configured as illustrated in FIG. 33 and FIG. 34, when the fold enhancing roller 410 is attempted to be rotated by the predetermined angle θ and stopped at the rotation angle θ, the fold enhancing processing unit 4 according to the embodiment can prevent the fold enhancing roller 410 from continuing to rotate in the same direction for a while after stopping the rotation of the fold enhancing roller driving motor 471.

That is, in the fold enhancing processing unit 4 according to the embodiment, it is prevented that, when the fold enhancing roller 410 is intended to be rotated by the predetermined angle θ and stopped at the rotation angle θ, the fold enhancing roller 410 actually stops after rotating more than the predetermined angle θ. Accordingly, even if the fold enhancing roller driving device 470 is configured as illustrated in FIG. 33 and FIG. 34, the fold enhancing processing unit 4 according to the embodiment can rotate the fold enhancing roller 410 by the predetermined angle θ and accurately stopping the fold enhancing roller 410 at the rotation angle θ, so that an accurate rotation angle of the fold enhancing roller 410 can be grasped all the time.

According to an embodiment, quality of a sheet after enhancing a fold thereof can be improved in a sheet processing device for enhancing the fold of the sheet conveyed in a folded state.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing device, comprising:

a folder configured to form a plurality of folds on a sheet such that a fold part and a part with no fold of the sheet overlap with each other;

a conveyance unit configured to convey the sheet on which the folds are formed by the folder;

a pressing part configured to press the fold part of the conveyed sheet in which the fold part and the part with no fold overlap with each other, from a side on which the fold part is located;

a rotation drive braking part configured to generate a driving force for rotating the pressing part and a braking force for stopping the rotation of the pressing part; and a driving force blocking part configured to transmit only a driving force for rotating the pressing part in a specific rotational direction out of the driving force generated by the rotation drive braking part, to the pressing part, and configured to block a driving force for rotating the pressing part in a direction opposite to the specific rotational direction, from the pressing part, wherein the pressing part is configured to rotate about an axis along a direction that is orthogonal to a conveying direction of the sheet and parallel to a surface of the sheet to press the fold part on the sheet conveyed from the folder in a folded state.

2. The sheet processing device according to claim 1, wherein the pressing part is configured to press the fold part of the sheet in which the fold part and the part with no fold overlap with each other between a front end and a rear end in a sheet conveying direction.

3. The sheet processing device according to claim 1, further comprising:

a sheet supporting part configured to support the sheet from a direction opposite to a pressing force; and a shock buffer that configured to be between the sheet and the pressing part and configured to buffer a shock caused by the pressing part pressing the fold part on the sheet in a state in which the folded sheet is supported by the sheet supporting part such that the pressing part presses the fold part of the sheet in which the fold part and the part with no fold overlap with each other, from the side on which the fold part is located.

4. The sheet processing device according to claim 1, further comprising a drive transmitting part for another driving unit configured to transmit the driving force blocked from the pressing part, to another driving unit.

5. The sheet processing device according to claim 1, wherein the driving force blocking part is configured to transmit, to the pressing part, only a driving force for rotating the pressing part in a rotational direction of when the pressing part presses the fold part on the sheet, and configured to block a driving force for rotating the pressing part in a direction opposite to the rotational direction, from the pressing part.

6. The sheet processing device according to claim 5, wherein the pressing part and a sheet supporting part are arranged such that the pressing part is located lower and the sheet supporting part is located higher with respect to a gravity direction.

7. The sheet processing device according to claim 1, wherein the pressing part includes a plurality of pressing members arranged in a direction parallel to the axis and to have certain angle differences from each other in a rotational direction using the axis as a rotation axis, and configured to rotate about the axis serving as the rotation axis to press the fold part on the sheet against a sheet supporting part at different timings with the plurality of pressing members.

8. An image forming system comprising:

an image forming apparatus configured to perform image formation output on a sheet;

a folder configured to perform folding processing on the sheet on which an image is formed by the image forming apparatus to form a fold on the sheet; and a sheet processing device according to claim 1 configured to press the fold part formed by the folder.

9. A sheet processing device, comprising:

a folder configured to form a plurality of folds on a sheet such that a fold part and a part with no fold of the sheet overlap with each other;

a conveyance unit configured to convey the sheet on which the folds are formed by the folder; and a pressing part configured to press the fold part of the conveyed sheet in which the fold part and the part with no fold overlap with each other, from a side on which the fold part is located, wherein the pressing part includes a plurality of pressing members arranged in a direction parallel to the axis and to have certain angle differences from each other in a rotational direction using the axis as a rotation axis, and configured to rotate about the axis serving as the rotation axis to press the fold part on the sheet against a sheet supporting part at different timings with the plurality of pressing members.

10. The sheet processing device according to claim 9, wherein the pressing part is configured to rotate about an axis along a direction that is orthogonal to a conveying direction of the sheet and parallel to a surface of the sheet to press the fold part on the sheet conveyed from the folder in a folded state.

11. The sheet processing device according to claim 10, further comprising:

a rotation drive braking part configured to generate a driving force for rotating the pressing part and a braking force for stopping the rotation of the pressing part; and a driving force blocking part configured to transmit only a driving force for rotating the pressing part in a specific rotational direction out of the driving force generated by the rotation drive braking part, to the pressing part, and configured to block a driving force for rotating the pressing part in a direction opposite to the specific rotational direction, from the pressing part.

12. The sheet processing device according to claim 9, wherein the pressing part is configured to press the fold part of the sheet in which the fold part and the part with no fold overlap with each other between a front end and a rear end in a sheet conveying direction.

13. The sheet processing device according to claim 9, further comprising:

a sheet supporting part configured to support the sheet from a direction opposite to a pressing force; and a shock buffer configured to be between the sheet and the pressing part and configured to buffer a shock caused by the pressing part pressing the fold part on the sheet in a state in which the folded sheet is supported by the sheet supporting part such that the pressing part presses the fold part of the sheet in which the fold part and the part with no fold overlap with each other, from the side on which the fold part is located.

14. The sheet processing device according to claim 9, further comprising a drive transmitting part for another driving unit configured to transmit the driving force blocked from the pressing part, to another driving unit.

15. The sheet processing device according to claim 9, wherein the driving force blocking part is configured to transmit, to the pressing part, only a driving force for rotating the pressing part in a rotational direction of when the pressing part presses the fold part on the sheet, and configured to block a driving force for rotating the pressing part in a direction opposite to the rotational direction, from the pressing part.

16. The sheet processing device according to claim 15, wherein the pressing part and a sheet supporting part are arranged such that the pressing part is located lower and the sheet supporting part is located higher with respect to a gravity direction.

17. An image forming system comprising:

an image forming apparatus configured to perform image formation output on a sheet;

a folder configured to perform folding processing on the sheet on which an image is formed by the image forming apparatus to form a fold on the sheet; and a sheet processing device according to claim 9 configured to press the fold part formed by the folder.

18. A sheet processing method comprising:

forming a plurality of folds on a sheet such that a fold part and a part with no fold of the sheet overlap with each other;

conveying the sheet on which the folds are formed;

pressing, via a pressing part, the fold part of the conveyed sheet in which the fold part and the part with no fold overlap with each other, from a side on which the fold part is located;

generating a driving force for rotating the pressing part and a braking force for stopping the rotation of the pressing part; and transmitting only a driving force for rotating the pressing part in a specific rotational direction out of the driving force to the pressing part, and configured to block a driving force for rotating the pressing part in a direction opposite to the specific rotational direction, from the pressing part, wherein the pressing part is configured to rotate about an axis along a direction that is orthogonal to a conveying direction of the sheet and parallel to a surface of the sheet to press the fold part on the sheet conveyed from the folder in a folded state.

* * * * *